US009857137B2

(12) United States Patent
Barrett

(10) Patent No.: US 9,857,137 B2
(45) Date of Patent: Jan. 2, 2018

(54) SILENCER FOR FIREARM

(71) Applicant: Sturm, Ruger & Company, Inc., Southport, CT (US)

(72) Inventor: Jonathan Barrett, Georges Mills, NH (US)

(73) Assignee: STURM, RUGER & COMPANY

( * ) Notice: Subject to any disclaimer, the term of this patent is extended or adjusted under 35 U.S.C. 154(b) by 217 days.

(21) Appl. No.: 14/950,132

(22) Filed: Nov. 24, 2015

(65) Prior Publication Data

US 2016/0187093 A1 Jun. 30, 2016

Related U.S. Application Data

(60) Provisional application No. 62/096,977, filed on Dec. 26, 2014.

(51) Int. Cl.
*F41A 21/30* (2006.01)
*F41A 21/28* (2006.01)

(52) U.S. Cl.
CPC ..... *F41A 21/30* (2013.01); *F41A 21/28* (2013.01)

(58) Field of Classification Search
CPC ..... F41A 21/30; F41A 21/32; F41A 21/325
USPC ..... 89/14.05, 14.4
See application file for complete search history.

(56) References Cited

U.S. PATENT DOCUMENTS 958,934 A 5/1910 Maxim
981,584 A 1/1911 Miller
1,111,202 A 9/1914 Westfall
1,173,687 A 2/1916 Thompson
1,259,251 A 3/1918 Love
1,874,326 A 8/1932 Mason
1,990,837 A 2/1935 Morgenstern
(Continued)

FOREIGN PATENT DOCUMENTS

AT 63622 2/1914
CN 202614087 12/2012
(Continued)

OTHER PUBLICATIONS

RANB, "Offset silencer design", Silencer Talk and Modern Rifle, Sound Suppressor Discussion, Apr. 10, 2011.
(Continued)

*Primary Examiner* — Samir Abdosh
(74) *Attorney, Agent, or Firm* — The Belles Group, P.C.

(57) ABSTRACT

A silencer for a firearm in one embodiment includes an outer tube defining a proximal end configured for mounting on a firearm barrel, a distal end, and an internal passageway extending between the ends. A plurality of first baffles is disposed in horizontally stacked relation in the internal passageway between the proximal and distal ends of the tube. The first baffles each comprises an annular mounting sleeve and a cone projecting axially rearward from the sleeve towards the proximal end of the tube. The cone defines an oblong obliquely angled central opening concentrically aligned the bore of a firearm barrel for receiving a projectile therethrough. Gas expansion chambers are formed between the first baffles. The cone may have an asymmetrically skewed shape for cross-jetting. An anti-rotation feature is provided which prevents the silencer assembly from loosening when the silencer is coupled to the firearm barrel.

24 Claims, 19 Drawing Sheets

(56) References Cited

U.S. PATENT DOCUMENTS

| | | | | |
|---|---|---|---|---|
| 2,444,910 | A | 7/1948 | Barker | |
| 2,448,593 | A * | 9/1948 | Heising | F41A 21/30 89/14.2 |
| 2,792,760 | A | 5/1957 | Hammer | |
| 3,748,956 | A | 7/1973 | Hubner | |
| 4,576,083 | A | 3/1986 | Seberger, Jr. | |
| 4,588,043 | A * | 5/1986 | Finn | F41A 21/30 181/223 |
| 5,029,512 | A | 7/1991 | Latka | |
| 5,679,916 | A | 10/1997 | Weichert | |
| 5,773,746 | A | 6/1998 | Vaden | |
| 6,079,311 | A | 6/2000 | O'Quinn et al. | |
| 6,308,609 | B1 | 10/2001 | Davies | |
| 6,374,718 | B1 * | 4/2002 | Rescigno | F41A 21/30 89/14.4 |
| 6,421,945 | B1 * | 7/2002 | Hengstenberg | F41A 21/40 42/51 |
| 6,425,310 | B1 * | 7/2002 | Champion | F41A 21/30 89/14.3 |
| 6,575,074 | B1 | 6/2003 | Gaddini | |
| 6,899,008 | B2 | 5/2005 | Breuer | |
| 7,237,467 | B1 | 7/2007 | Melton | |
| 7,308,967 | B1 | 12/2007 | Hoel | |
| 7,587,969 | B2 | 9/2009 | Silvers | |
| 7,789,008 | B2 * | 9/2010 | Petersen | F41A 21/30 89/14.4 |
| 7,856,914 | B2 | 12/2010 | Shults et al. | |
| 7,874,238 | B2 * | 1/2011 | Silvers | F41A 21/30 181/223 |
| D651,680 | S | 1/2012 | DeGroat | |
| 8,087,338 | B1 | 1/2012 | Hines | |
| 8,100,224 | B1 | 1/2012 | Olson | |
| 8,162,100 | B2 | 4/2012 | Shults et al. | |
| 8,210,087 | B2 | 7/2012 | Latka | |
| 8,453,789 | B1 * | 6/2013 | Honigmann | F41A 21/30 181/223 |
| 8,459,405 | B1 | 6/2013 | Dueck | |
| 8,459,406 | B1 | 6/2013 | Dueck | |
| 8,474,361 | B2 | 7/2013 | Brittingham | |
| 8,505,680 | B2 * | 8/2013 | Dueck | F41A 21/325 181/223 |
| 8,511,425 | B2 | 8/2013 | Larue | |
| 8,528,691 | B1 | 9/2013 | Carmichael et al. | |
| 8,567,556 | B2 * | 10/2013 | Dueck | F41A 21/30 181/223 |
| 8,579,075 | B2 | 11/2013 | Brittingham et al. | |
| 8,584,794 | B2 | 11/2013 | Dueck | |
| 8,714,301 | B2 | 5/2014 | Shults | |
| 8,739,922 | B2 | 6/2014 | Wirth et al. | |
| 8,807,005 | B2 | 8/2014 | Moss et al. | |
| 8,844,422 | B1 | 9/2014 | Klett | |
| 8,857,307 | B2 | 10/2014 | Torre et al. | |
| 8,875,612 | B1 | 11/2014 | Klett et al. | |
| 8,910,745 | B2 | 12/2014 | Latka | |
| 8,950,546 | B2 | 2/2015 | Shults et al. | |
| 8,973,481 | B2 | 3/2015 | Dueck et al. | |
| 8,978,818 | B2 | 3/2015 | Proske | |
| 8,991,550 | B2 | 3/2015 | Coley | |
| 8,991,551 | B2 | 3/2015 | Latka | |
| 8,991,552 | B2 | 3/2015 | Latka | |
| 9,086,248 | B2 * | 7/2015 | Young | F41A 21/30 |
| 9,097,482 | B1 * | 8/2015 | Holden | F41A 21/30 |
| 9,102,010 | B2 | 8/2015 | Wilson | |
| 2008/0251060 | A1 | 10/2008 | Thurber | |
| 2010/0180759 | A1 * | 7/2010 | Petersen | F41A 21/30 89/14.4 |
| 2011/0297477 | A1 | 12/2011 | Koumbis | |
| 2012/0152093 | A1 | 6/2012 | Koumbis | |
| 2012/0291614 | A1 * | 11/2012 | Koumbis | F41A 21/30 89/14.4 |
| 2013/0180150 | A1 * | 7/2013 | Dueck | F41A 21/325 42/90 |
| 2013/0180796 | A1 * | 7/2013 | Dueck | F41A 21/30 181/223 |
| 2013/0180797 | A1 * | 7/2013 | Dueck | F41A 21/30 181/223 |
| 2014/0020976 | A1 | 1/2014 | Shults | |
| 2014/0157640 | A1 | 6/2014 | Whelan | |
| 2014/0158249 | A1 | 6/2014 | Schlosser | |
| 2014/0224574 | A1 | 8/2014 | Latka | |
| 2014/0224575 | A1 | 8/2014 | Latka | |
| 2014/0231168 | A1 * | 8/2014 | Dueck | F41A 21/325 181/223 |
| 2014/0237881 | A1 * | 8/2014 | Mack | F41A 21/325 42/90 |
| 2014/0262604 | A1 | 9/2014 | Proske | |
| 2014/0262605 | A1 | 9/2014 | Washburn, III et al. | |
| 2014/0299405 | A1 | 10/2014 | Miller et al. | |
| 2014/0374189 | A1 * | 12/2014 | Young | F41A 21/30 181/223 |
| 2015/0001002 | A1 | 1/2015 | Wirth et al. | |
| 2015/0090105 | A1 * | 4/2015 | Pace | F41A 21/30 89/14.4 |
| 2015/0159971 | A1 | 6/2015 | Salva | |
| 2015/0184968 | A1 | 7/2015 | Fischer et al. | |
| 2015/0226506 | A1 | 8/2015 | Shults et al. | |
| 2015/0338184 | A1 * | 11/2015 | White | F41A 21/30 89/14.4 |
| 2016/0003570 | A1 * | 1/2016 | Tonkin | F41A 21/02 89/14.4 |
| 2016/0187093 | A1 * | 6/2016 | Barrett | F41A 21/30 89/14.4 |
| 2017/0191780 | A1 * | 7/2017 | Barrett | F41A 21/325 |

FOREIGN PATENT DOCUMENTS

| | | |
|---|---|---|
| CN | 204373498 | 6/2015 |
| GB | 190814310 | 11/1908 |
| GB | 190900455 | 2/1909 |
| GB | 191024766 | 7/1911 |
| GB | 579168 | 7/1946 |
| RU | 2307991 | 10/2007 |
| RU | 2345305 | 1/2009 |
| WO | 2013057139 | 4/2013 |
| WO | 2014000805 | 1/2014 |
| WO | 2014076356 | 5/2014 |
| WO | 2014076357 | 5/2014 |

OTHER PUBLICATIONS

Bev Fitchett's Guns Magazine—Improvised Weaponry, 'Ram Pipe Cross Sections', Dec. 28, 2015, Atlanta, GA.

vBulletin Solutions, Inc., 'Forum—Community—Off-Topic Discussion—Off-Topic—Suppressor or Silencer', Thread: Suppressor or Silencer.

Corresponding International Search Report and Written Opinion for PCT/US15/62288 dated Jun. 3, 2016.

* cited by examiner

SILENCER FOR FIREARM

BACKGROUND OF THE DISCLOSURE

The present application claims the benefit of priority to U.S. Provisional Application No. 62/096,977 filed Dec. 26, 2014, which is incorporated herein by reference in its entirety.

BACKGROUND OF THE DISCLOSURE

The present disclosure generally relates to firearms, and more particularly to silencers or suppressors which reduce the muzzle noise produced by discharging the firearm.

Silencers or suppressors generally comprise multiple combustion gas expansion chambers in which the high pressure gas is allowed to partially expand prior to leaving the firearm. The projectile such as a bullet is propelled through the barrel of the firearm and silencer by the combustion gas. In an unsuppressed discharge firearm, the rapid expansion and depressurization of the high pressure gas at the muzzle end of the barrel produces a loud sound referred to as muzzle blast or noise. The partial pre-expansion of gas inside the silencer acts to reduce muzzle noise which is desirable in some circumstances. Silencers are typically configured for threadable and removable mounting on the muzzle end of the firearm barrel.

Improvements in silencer designs is desired

SUMMARY OF THE DISCLOSURE

The present invention provides a silencer including an outer housing or tube and a plurality of interconnected internal baffle segments which are joined together in stacked relationship to create a substantially gas-tight internal volume. The baffles have cone sections which are longitudinally spaced apart and create a plurality of gas expansion chambers therebetween which allow for partial expansion of the high pressure combustion gases prior to exiting the silencer, thereby reducing the muzzle blast or noise. In some configurations, the primary baffles may have an asymmetrically shaped skewed cone section configured to maximize gas expansion and noise reduction performance. Advantageously, the gas impinging the rear face of the primary baffles upon discharging the firearm is momentarily directed to pool at the lowest most recessed part of the face. As pressure builds on the face of the baffle, the gas spills over and flows into the central aperture of the cone creating cross-jetting gas flow pattern into the direct main flow of gas through the central aperture from the barrel.

In one implementation, an anti-rotational locking feature is provided which is formed by mating keyed parts of the outer tube and proximal muzzle mount. The muzzle mount may comprise a male rotational locking feature and the tube may comprise a complementary configured and mating female locking feature to form an interlock that prevents relative movement of the mount with respect to the tube so that the tube cannot be inadvertently disassembled and/or loosened from the muzzle mount of the silencer when removing the silencer from the barrel of the firearm. In other implementations possible, the male and female locking features on the tube and muzzle mount may be reversed so that the tube contains the male feature and the muzzle mount the female feature. In one non-limiting embodiment, the locking features may be formed by mating radial splines and grooves formed in the muzzle mount and tube.

In one exemplary embodiment, a silencer for a firearm includes a longitudinal axis; an outer tube defining a proximal end configured for mounting on a firearm barrel, a distal end, and an internal passageway extending between the proximal and distal ends; and a plurality of first baffles longitudinally stacked in the internal passageway between the proximal and distal ends of the outer tube. Each of the first baffles comprise an annular mounting sleeve disposed adjacent the outer tube and a cone projecting axially rearward from the mounting sleeve towards the proximal end of the outer tube, the cone defining an oblong central opening concentrically aligned with the longitudinal axis for receiving a projectile therethrough. The oblong central opening is obliquely angled to the longitudinal axis of the silencer. A plurality of gas expansion chambers are formed between the first baffles.

A firearm with silencer includes a barrel having a barrel bore for receiving a projectile and a threaded muzzle end; a longitudinal axis coaxial with the barrel bore; and a silencer. The silencer comprises an outer tube defining an internal passageway extending between proximal and distal ends of the outer tube; a distal end cap attached to the distal end of the outer tube and defining an exit aperture coaxially aligned with the longitudinal axis; a proximal end cap attached to the proximal end of the outer tube and defining an entrance aperture coaxially aligned with the longitudinal axis; a muzzle mount disposed in the proximal end of the outer tube, the muzzle mount threadably engaging the threaded muzzle end of the barrel coupling the silencer thereto; a plurality of primary baffles longitudinally stacked inside the outer tube between the proximal and distal end caps; and a blast baffle disposed between the primary baffles and proximal end cap. An anti-rotation feature is provided comprising a plurality of circumferentially spaced apart radial splines formed on one of the muzzle mount or outer tube, each radial spline engaging a mating axial groove formed in the other one of the muzzle mount or outer tube without the splines. The anti-rotation feature prevents relative rotation between the muzzle mount and outer tube when the silencer is threaded onto the barrel.

A method for assembling a silencer for a firearm is provided. The method includes: providing an outer tube, a rear end cap, a front end cap, and a muzzle mount, the outer tube defining a rear end for threadable mounting on a firearm barrel, a front end, and an internal passageway extending between the front and rear ends; slideably inserting a plurality of baffles into the internal passageway through the rear or front end of the outer tube; axially aligning a plurality of radial splines on the muzzle mount or the outer tube with a mating plurality of axial grooves on the other of the muzzle mount or the outer tube without the radial splines; slideably inserting the muzzle mount through the rear end of the outer tube towards the front end by slideably engaging the splines in the grooves; and threadably coupling the rear end cap onto the rear end of the outer tube, the muzzle mount being locked into the outer tube by the rear end cap; wherein relative rotation between the muzzle mount and outer tube is prevented by engagement between the radial splines and the axial grooves.

BRIEF DESCRIPTION OF THE DRAWINGS

The features of the exemplary embodiments will be described with reference to the following drawings where like elements are labeled similarly, and in which:

All drawings are schematic and not necessarily to scale. Parts shown and/or given a reference numerical designation in one figure may be considered to be the same parts where they appear in other figures without a numerical designation for brevity unless specifically labeled with a different part number and described herein. References herein to a figure number (e.g. FIG. 1) shall be construed to be a reference to all subpart figures in the group (e.g. FIGS. 1A, 1B, etc.) unless otherwise indicated

DESCRIPTION OF EMBODIMENTS

Figure 1:
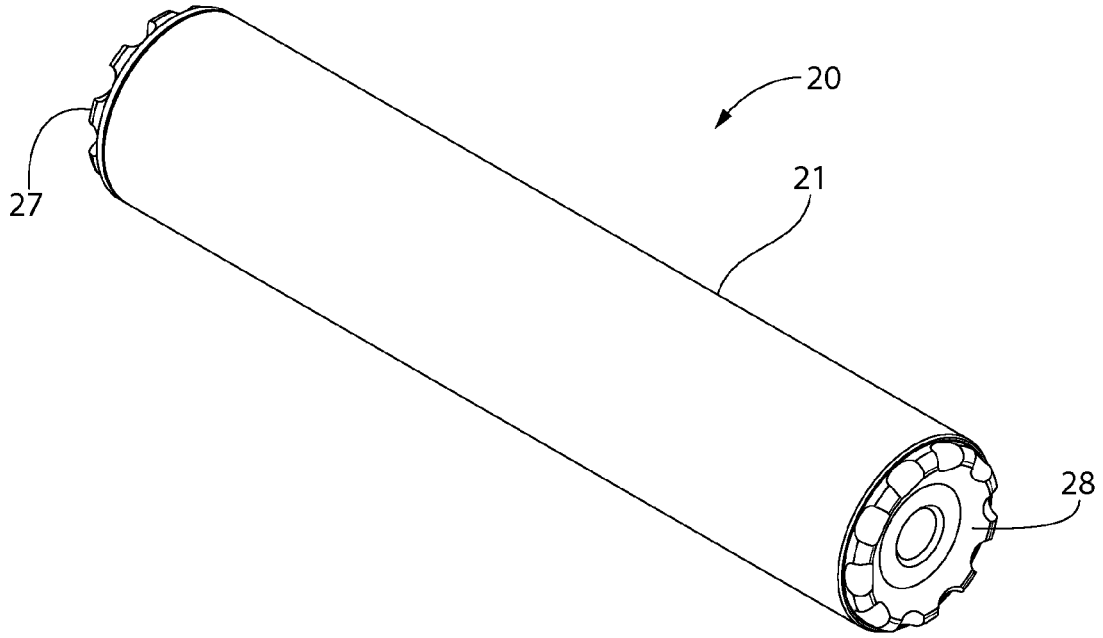
FIGS. 1 and 2 are front and rear perspective views respectively of a silencer for a firearm according to the present disclosure.
Figure 2:
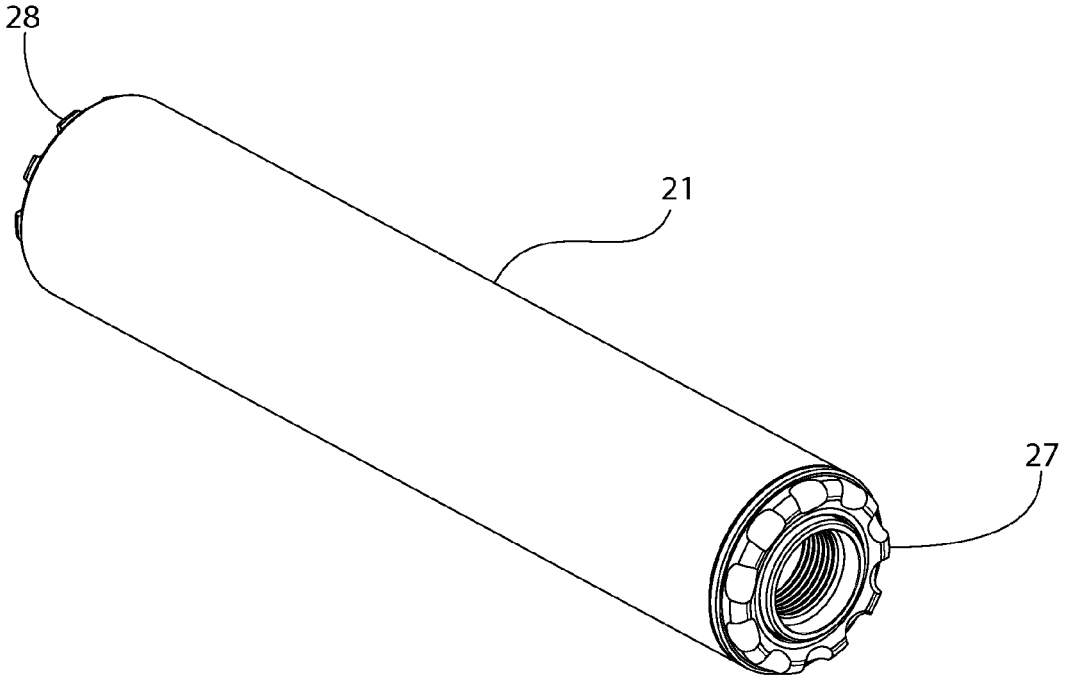

The features and benefits of the invention are illustrated and described herein by reference to exemplary embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," and "interconnected," refer to a relationship wherein structures are secured or attached to one another either directly or indirectly through intervening structures, as well as both movable or rigid attachments or relationships, unless expressly described otherwise. Accordingly, the disclosure expressly should not be limited to such exemplary embodiments illustrating some possible non-limiting combination of features that may exist alone or in other combinations of features.

An exemplary embodiment will now be described with initial reference to FIGS. 1-8. The silencer described herein is usable with many types of firearms including without limitation rifles, pistols, and revolvers. Accordingly, the invention is not limited in application to any particular type of firearm.

Silencer 20 generally includes an elongated outer tube 21 defining a longitudinal axis LA (and corresponding axial direction), a plurality of horizontally stacked baffles including a proximal blast baffle 50 and plurality of primary baffles 70 all removably inserted in the tube, a rear proximal end cap 27 removably attached to the tube at one end closest to the firearm barrel 18, a front distal end cap 28 removably attached to the tube at an opposite end farthest from the firearm barrel, and a muzzle mount 90 removably disposed at least partially inside the tube. The proximal or rear end of the silencer 20 is defined as the end which mounts on the muzzle end 18*c* of the firearm barrel 18 and receives a projectile therethrough from the barrel bore 18*a* (see, e.g. FIGS. 3 AND 7B) while the distal or front end of the silencer is defined as the opposite end from which the projectile exits the silencer when the firearm is fired.

The outer tube 21 has a hollow tubular body including a cylindrical sidewall 24 that defines a rear or proximal muzzle mount end 22 ("proximal end" for brevity), a front or distal projectile discharge end 23 ("distal end" for brevity), and an internal passageway 25 extending axially between the ends. The ends 22 and 23 may be fully open in one embodiment without any flanges or other inwardly or outwardly radially extending protrusions which simplifies manufacture of the tube. The interior surface 26 of the tube (e.g. sidewall 21) is generally smooth with internal threading at the proximal and distal ends 22, 23 for threadably mounting the externally threaded proximal and distal end caps 27, 28 thereto. The outer surface 29 of the tube 21 may be solid in structure (i.e. free of through holes or apertures) and generally plain without threading or other type surface features in one embodiment.

The internal passageway 25 of the tube 21 and particularly central bores or apertures of baffles 50, 70 collectively define a projectile pathway P through the silencer 20 which extends along the longitudinal axis LA in a direction from the proximal end 22 to distal end 23 of the silencer. Pathway P coincides with the direction followed by a projectile from the barrel bore 18*a* when the firearm is discharged and exiting the distal end 28 (see, e.g. directional passageway P arrows in FIGS. 7A-B).

With additional reference to FIGS. 9-13, the front or distal end cap 28 is generally annular in shape including front end 30, rear end 31, and a cylindrical circumferential sidewall 32 extending between the ends. The front end 30 includes a circular substantially vertical end wall 38 in end view and a rearwardly open recess 38*a* defined by the sidewall 32. External threads 33*a* disposed on sidewall 32 proximate to rear end 31 engage mating threads 33*b* formed on the interior surface 26 of the outer tube 21 proximate to its distal end 23 for mounting the end cap to the tube.

The distal end cap 28 has a partially closed front end 30 formed by vertical end wall 38 which is interrupted by a centered exit aperture 35 that is in fluid communication with the internal passageway 25 of the silencer 20. Aperture 35 is sized to allow a fired projectile such as a bullet or slug to pass therethrough. Exit aperture 35 is coaxially and concentrically aligned with the longitudinal axis LA and barrel bore 18*a*, respectively. In one non-limiting embodiment, the exit aperture 35 continues and opens rearward into an axial bore formed by tubular extension 34 disposed in cavity 38*a* inside the end cap 28. The tubular extension 34 may be integrally formed with end wall 38 in one embodiment and extends rearwardly/proximally from the wall towards the rear end 31. In one implementation, the tubular extension 34 may project rearwards beyond the sidewall 32 at rear end 31 of the distal end cap 28. Extension 34 has a smaller inside diameter than the inside diameter of the end cap sidewall 32 creating an annular gap therebetween in which combustion gas may continue to expand partially. The front end 30 of the cap 28 may be castellated in some embodiments for grasping by the hand and/or tool (e.g. specially configured wrench) to facilitate assembling the silencer. A circumferential groove 36 may be provided on the outer surface of the distal end cap 28 which receives a complementary configured annular seal 37. Seal 37 may be an O-ring formed of suitable material such as rubber to help prevent loss of torque due to the repeated firing of a mounted firearm.

Referring to FIGS. 2-4, 6-8, and 26, the rear or proximal end cap 27 is generally annular in shape including front end 40, rear end 41, and a cylindrical circumferential sidewall 42 extending between the ends. Sidewall 42 defines a mounting portion of the end cap 27. External threads 43*a* disposed on sidewall 32 proximate to front end 40 engage mating internal threads 43*b* formed on the interior surface 26 of the outer tube 21 proximate to its proximal end 22 for mounting the end cap to the tube.

An entrance aperture 44 is formed in rear end 41 of proximal end cap 27 sized to receive a portion of the muzzle mount 90 therethrough to allow a projectile such as a bullet or slug to pass from the bore 18*a* of the firearm barrel 18 directly into the muzzle mount and silencer 20, as further described herein. Entrance aperture 44 is coaxially and concentrically aligned with the longitudinal axis and barrel bore 18*a*, respectively. The rear end 41 of the proximal cap 27 may be castellated in some embodiments to facilitate grasping by the hand and/or tool (e.g. specially configured wrench) to assemble the silencer. A radially protruding rim 45 extending outwards from sidewall 42 abuttingly engages the rear facing end surface on the proximal end 22 of the outer tube 21 when the proximal cap 27 is threaded onto the tube to form an end closure. The outside diameter of rim 45 is thus larger than the inside diameter of the proximal end 22 of the outer tube in this embodiment to form the surface contact. This arrangement limits the insertion depth of the proximal end cap 27 inside the outer tube 21.

Referring now to FIGS. 2-3, 6-8, 14-18, and 25-26, muzzle mount 90 is mounted at the proximal end 22 of the outer tube 21 inside the internal passageway 25 and configured to threadably and removably couple silencer 20 to the muzzle end 18*c* of the firearm barrel 18. Muzzle mount 90 comprises a front end 91, rear end 92, and a cylindrical sidewall 93 extending axially between the ends. The sidewall 93 defines an open and tubular annular mounting sleeve 94 sized for placement adjacent the inside surface 26 of the silencer outer tube 21. Sleeve 94 thus has an outside diameter which is slightly smaller than the inside diameter of outer tube 21 sufficient to allow the muzzle mount 90 to be slid inside the tube from the open proximal end 22. Preferably, relatively close contact is maintained between the tubular sleeve 94 and inside of the outer tube to prevent excessive lateral movement (i.e. transverse to longitudinal axis LA) of the muzzle mount when discharging the firearm to avoid excessive vibration. The interior of the tubular sleeve 94 forms a forwardly open cavity 104 that in turn defines one of several combustion gas expansion chambers 110 when the silencer is assembled, as further described herein.

Muzzle mount 90 further includes an internally threaded bore 95 configured to rotatably engage mating external threads 18*b* formed on muzzle end 18*c* of the firearm barrel 18 (see, e.g. FIGS. 3 and 7B) for removably mounting the silencer 20 thereto. In one implementation, threaded bore 95 may be formed inside a rearwardly open nozzle 96 concentrically aligned with the bore 18*a* of barrel 18. Barrel 18 is inserted into the nozzle 96 and then rotated to mutually engage the threading (see, e.g. FIGS. 7 and 8). The rear end 92 of the muzzle mount 90 is defined by the terminal edge of the nozzle 96.

In one embodiment, nozzle 96 has a reduced outside diameter with respect to the outside diameter of the tubular sleeve 94 of muzzle mount 90. This creates a rearwardly open annular space 97 between the nozzle and inside of the outer sleeve that receives the threaded sidewall 42 of the rear or proximal end cap 27 (best shown in FIG. 27 without end cap 27 in place). The internal threads 43*b* on the interior surface 26 of the outer tube 21 are exposed in space 97 to engage the mating threads 43*a* on the exterior of proximal end cap 27 when attached. A circumferential groove 99 is formed on the nozzle 96 between the rear end 92 and the tubular sleeve 94 which receives a complementary configured annular seal 100. Seal 100 may be an O-ring formed of suitable material such as rubber that helps prevent loss of torque due to the repeated firing of a mounted firearm.

A shoulder 98 is formed between nozzle 96 and tubular sleeve 94 that defines a rear facing annular seating surface 101 arranged to abuttingly engage a front facing end surface on the front end 40 of proximal end cap 27. When the silencer 20 is assembled, this compresses the stack of baffles 50 and 70 between the front or distal end cap 28 and the seating surface 101.

According to one aspect of the invention, the muzzle mount 90 is keyed to the outer tube 21 via an anti-rotation mechanism that prevents relative rotation between the two components. In one embodiment, the anti-rotation mechanism is provided a plurality of radially protruding splines 102 formed on the exterior of muzzle mount 90 which engage complementary configured and arranged axial grooves 103 formed inside the rear end 27 of the tube 21. This rotational keyed arrangement allows for the user to apply torque to the outer tube 21 when removing the silencer 20 from the firearm barrel 18 without fear of accidentally disassembling or loosening the silencer assembly.

Figure 27:
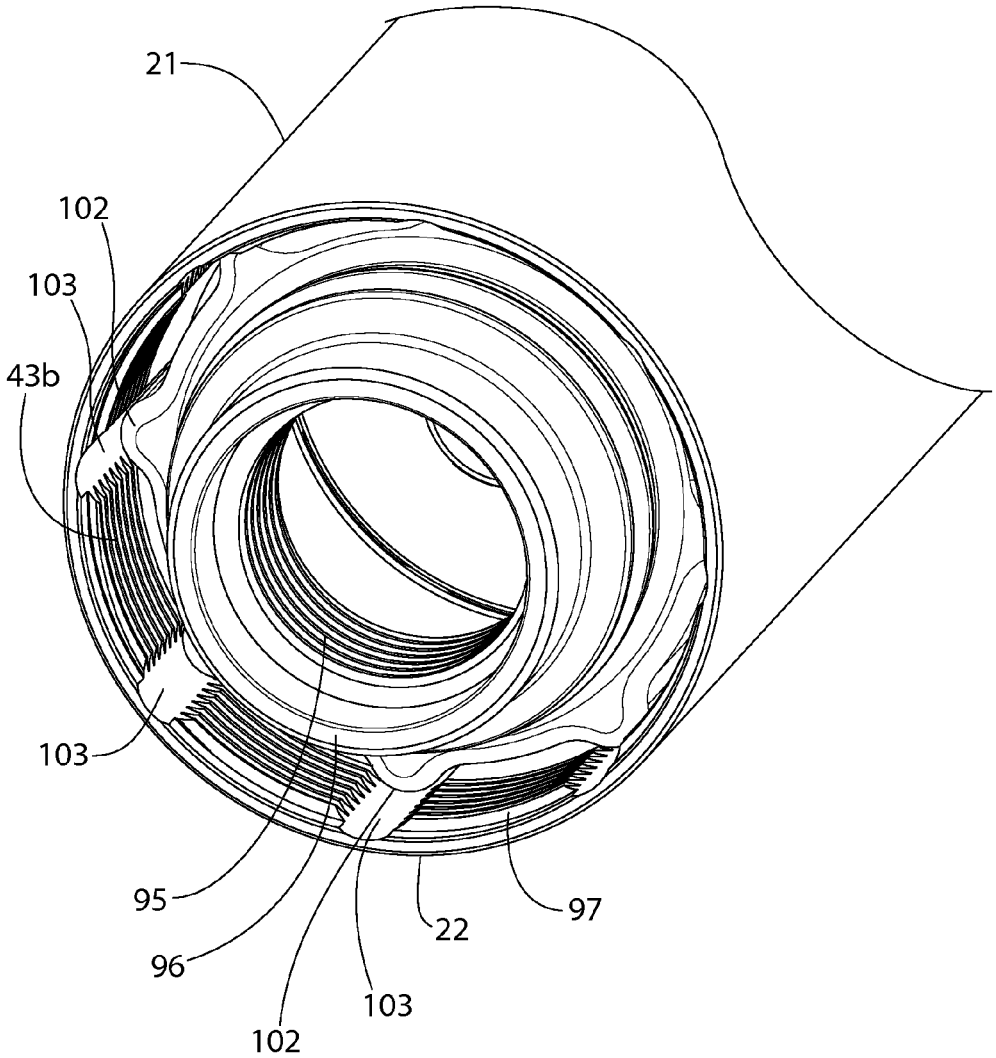
FIG. 27 is a rear perspective view of the silencer with the rear or proximal end cap removed.

In one implementation, the anti-rotation splines 102 may be formed between the tubular sleeve 94 and nozzle 96 on the muzzle mount 90 and extend outwards beyond the sleeve to engage axial grooves 103. The splines 102 are circumferentially spaced apart on the muzzle mount adjacent shoulder 98 on the larger diameter tubular sleeve 94 and extend around the entire circumference of the mount. Grooves 103 inside outer tube 21 are circumferentially spaced apart and have a complementary arrangement so that each groove corresponds to and cooperates with a mating spline 102 to rotationally key the mount to the tube. In one embodiment, the axial grooves 103 form interruptions in the internal threads 43*b* of the outer tube 21 as best shown in FIG. 27. The axial grooves 103 penetrate and extend forward from the rear proximal end 22 of outer tube 21 for a sufficient distance so that a proximal-most portion of the internal threads 43*b* of the outer tube remain exposed to engage the threads on the rear end cap 27 (see, e.g. FIG. 27).

Figure 3:
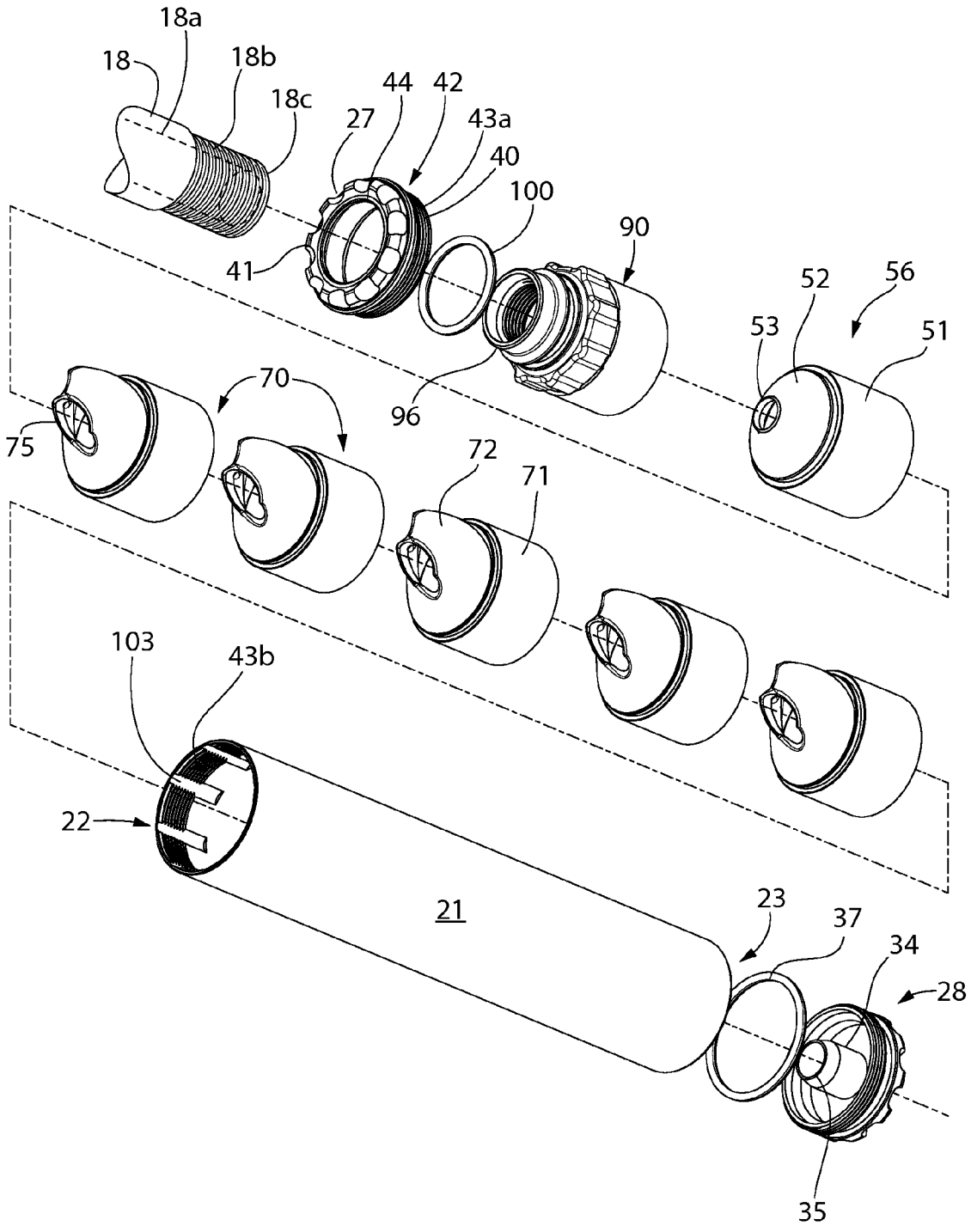
FIG. 3 is an exploded perspective view of the silencer.
Figure 4:
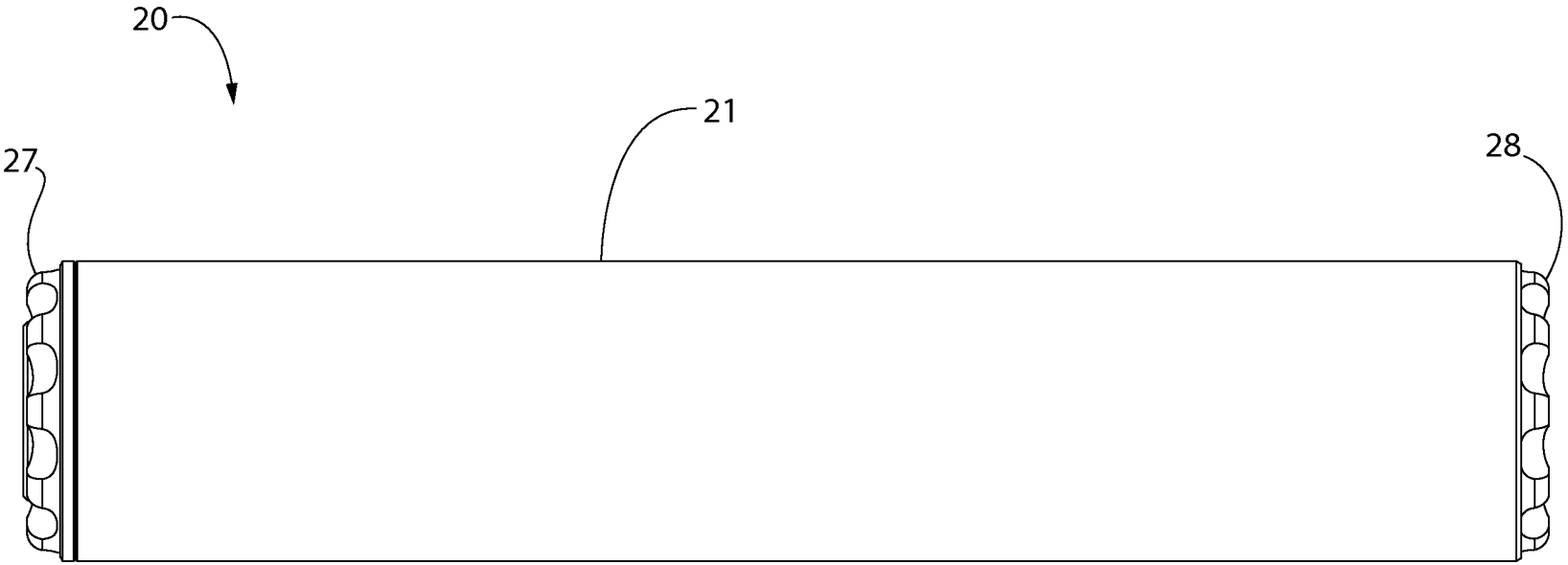
FIG. 4 is a side view of the silencer.
Figure 5:
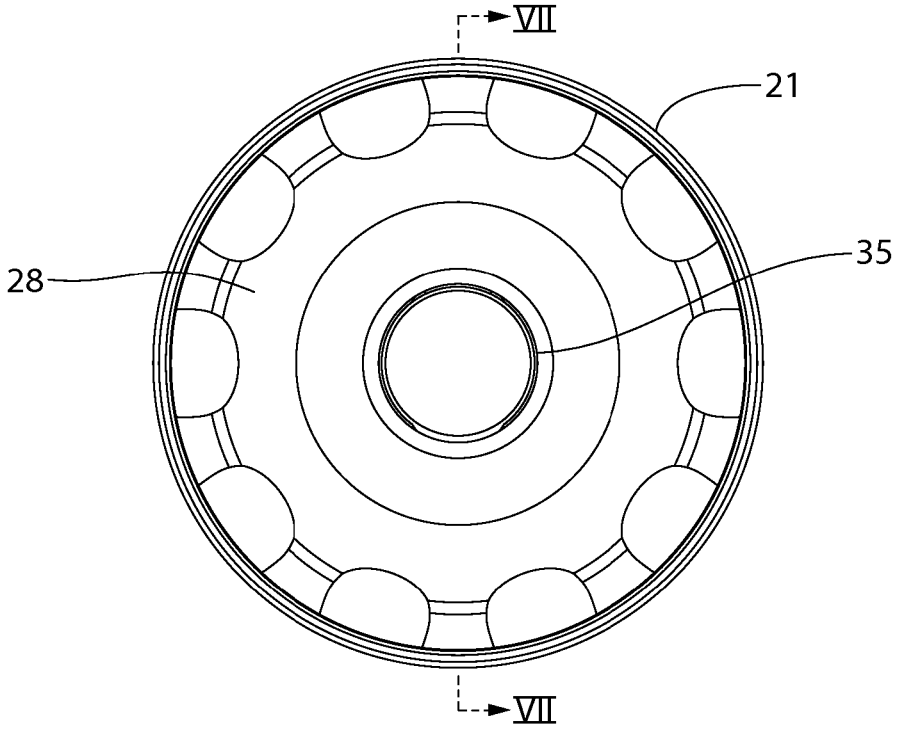
FIGS. 5 and 6 are front and rear end views of the silencer.
Figure 6:
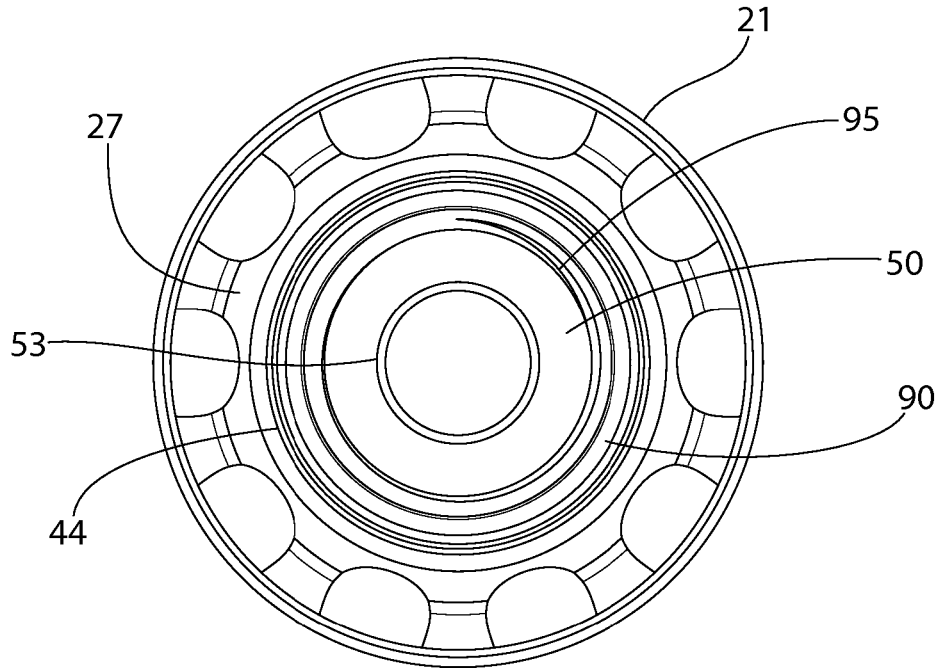
Figure 7A:
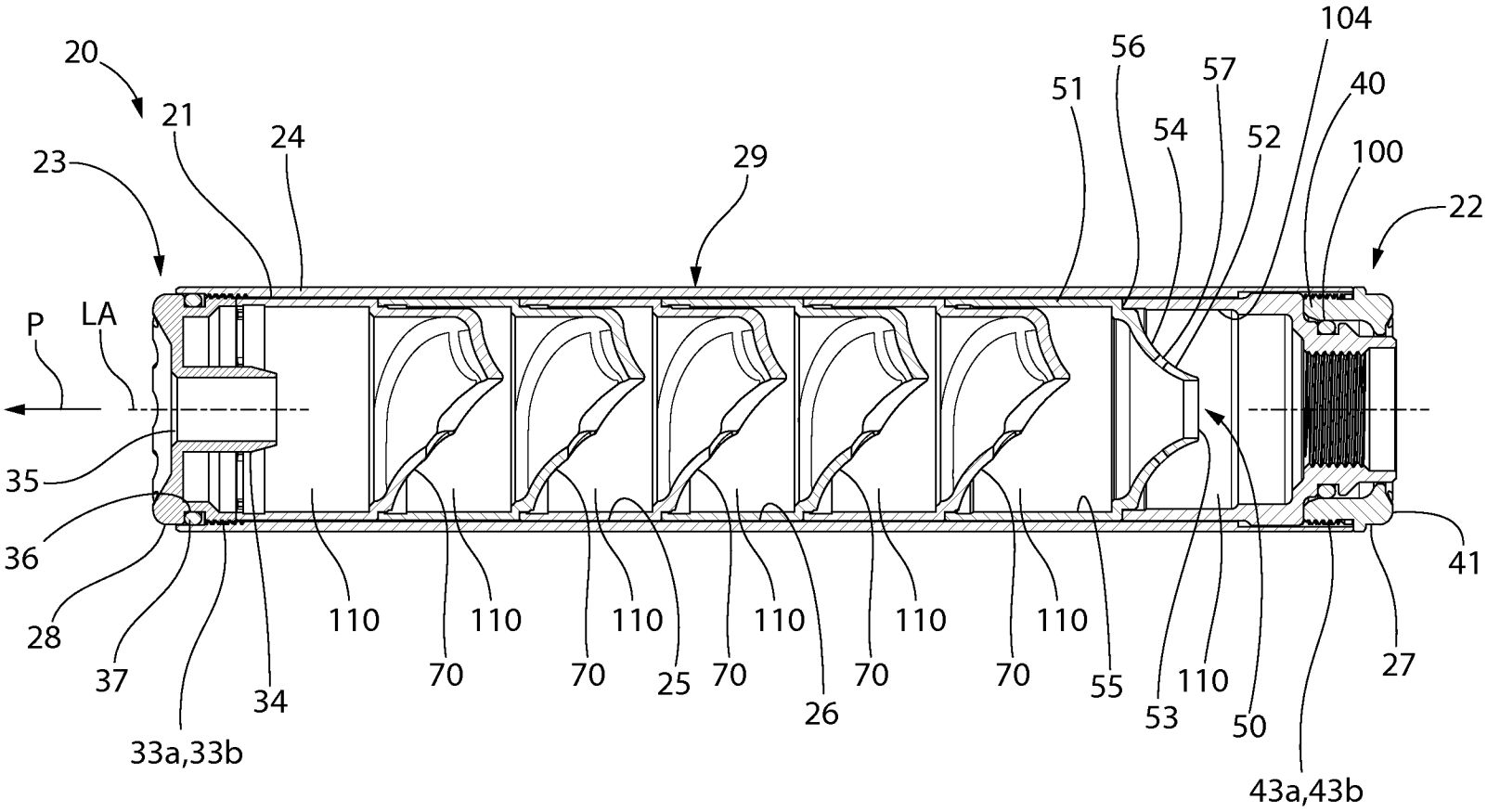
FIG. 7A is a longitudinal cross-sectional view of the silencer.
Figure 7B:
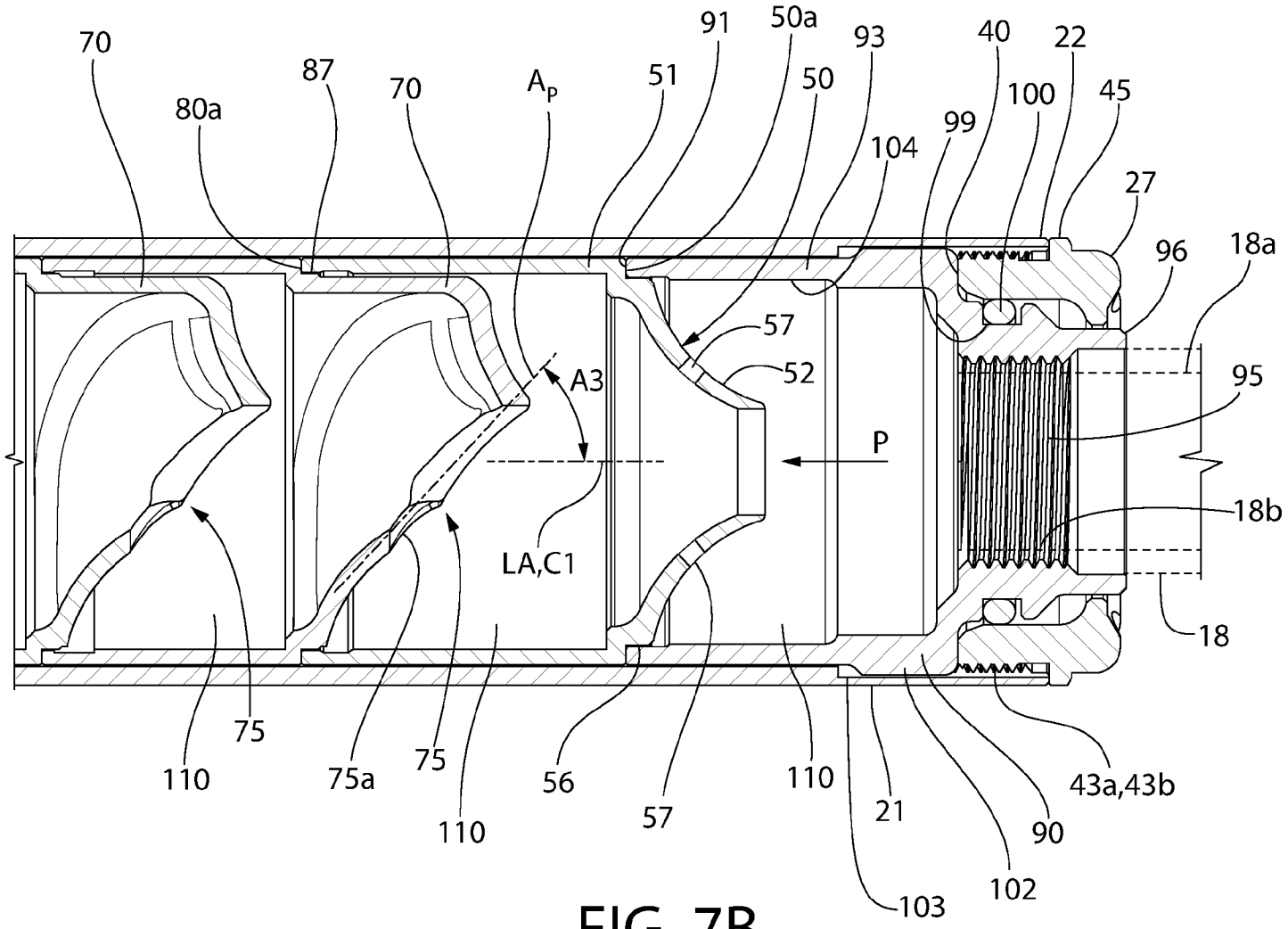
FIG. 7B is an enlarged detail view of the rear end of the silencer from FIG. 7A.
Figure 8:
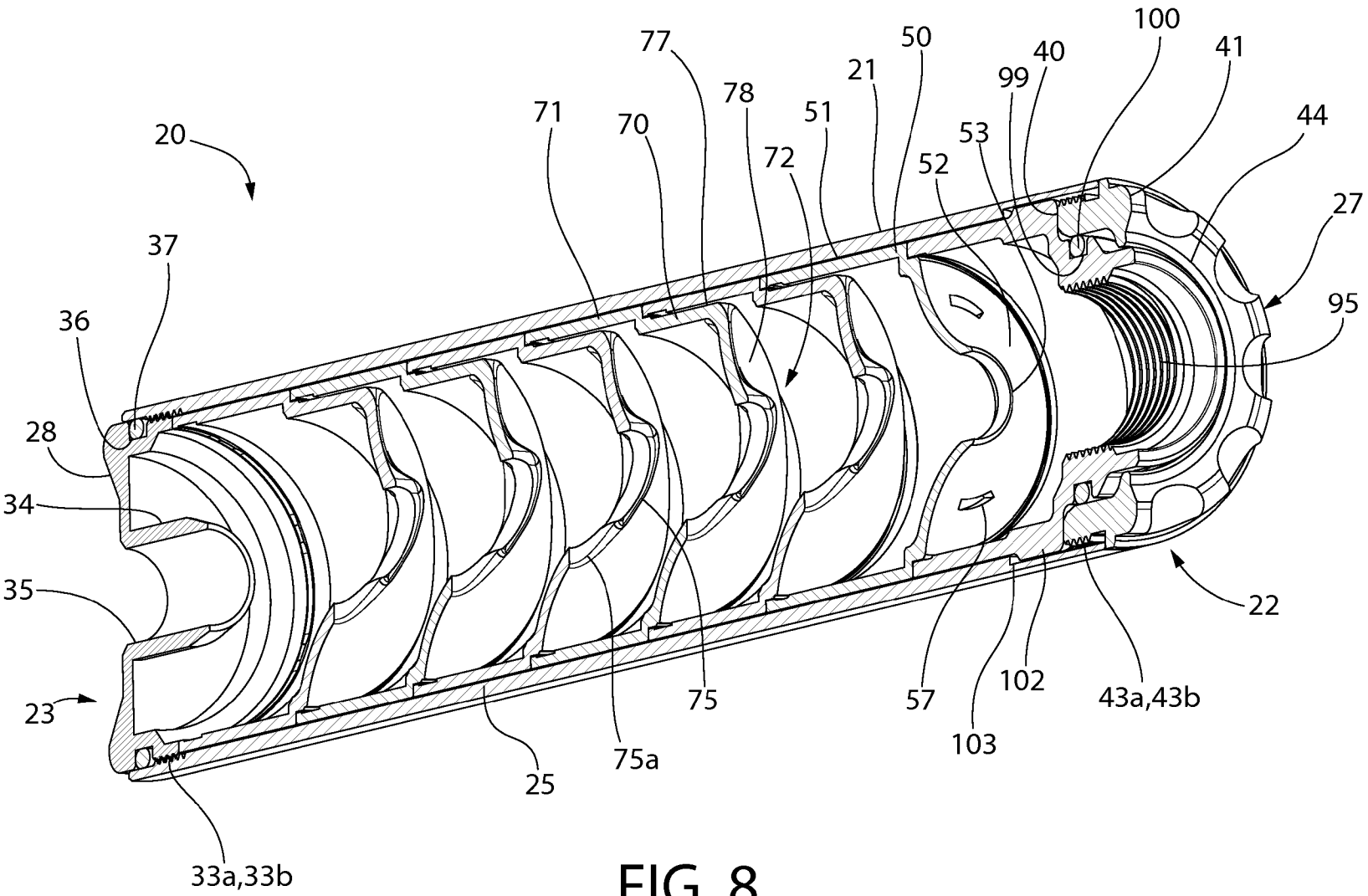
FIG. 8 is a rear cross-sectional perspective view of the silencer.
Figure 9:
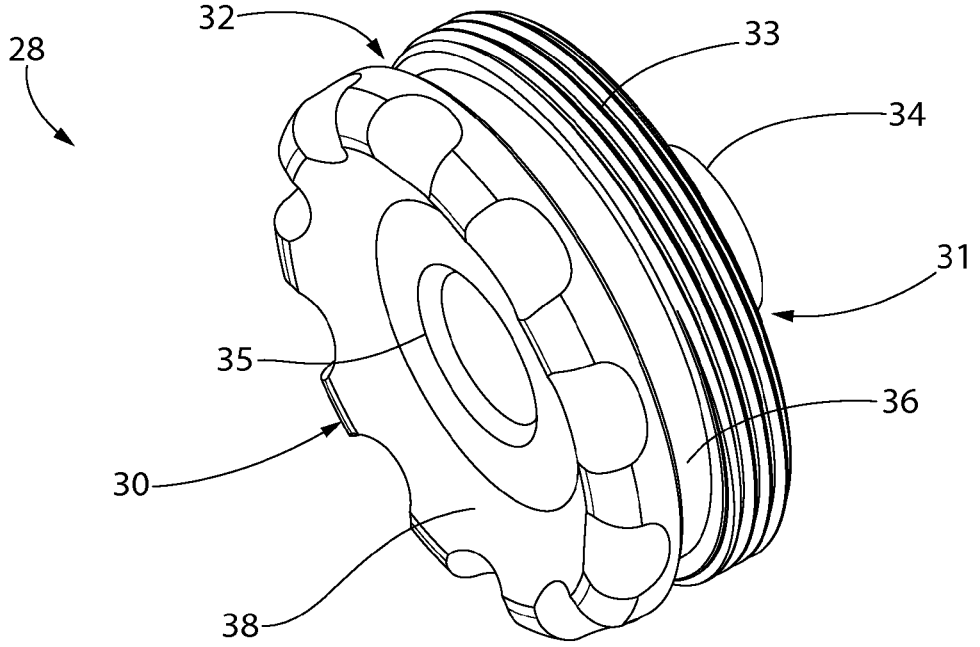
FIGS. 9 and 10 are front and rear perspective views respectively of the front end cap of the silencer.
Figure 10:
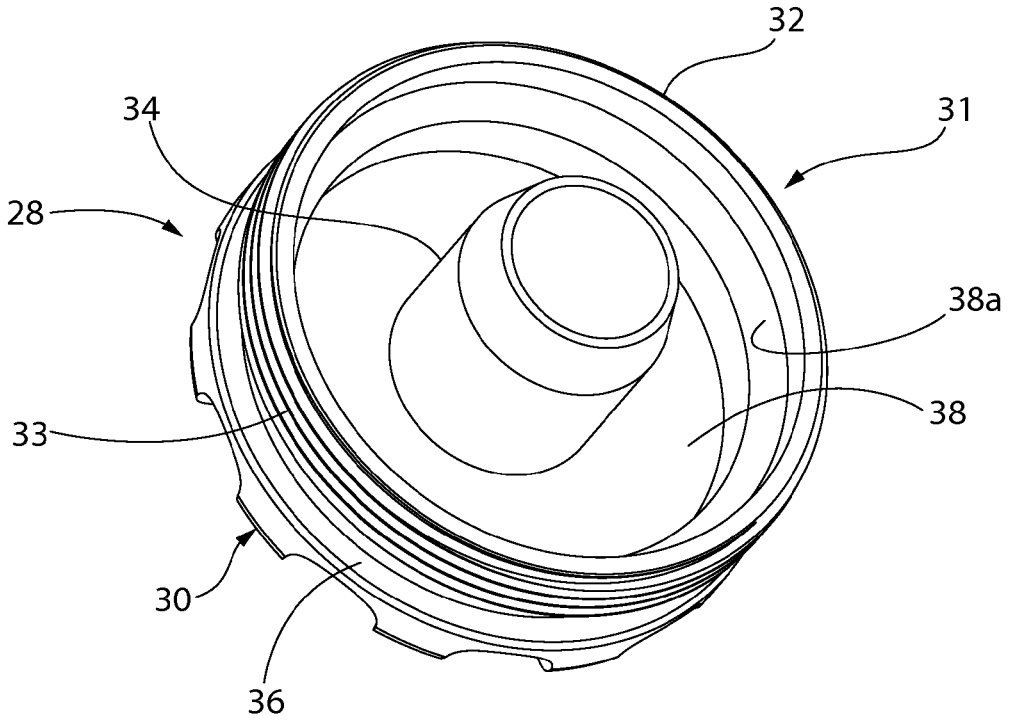
Figure 11:
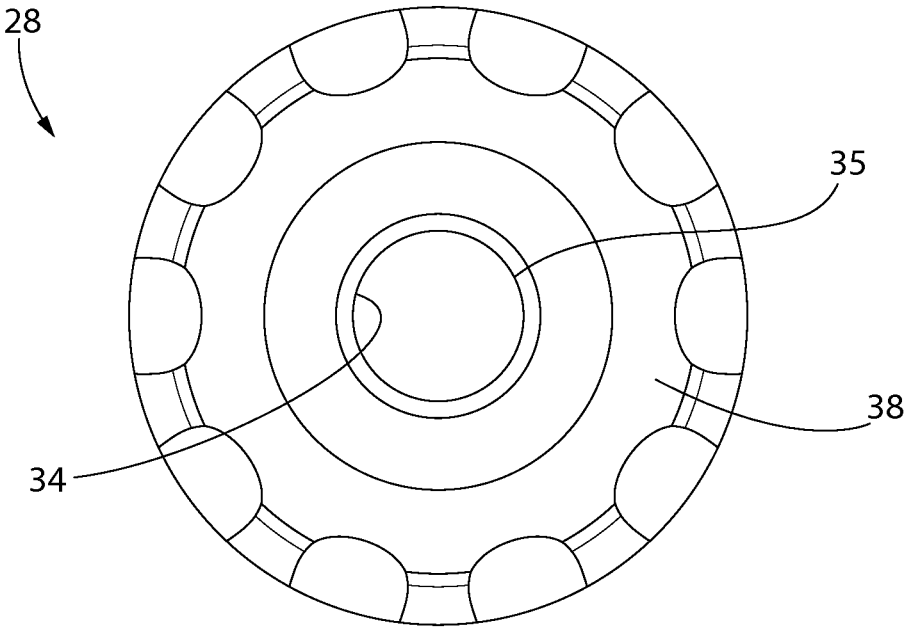
FIGS. 11 and 12 are front and rear end views respectively thereof.
Figure 12:
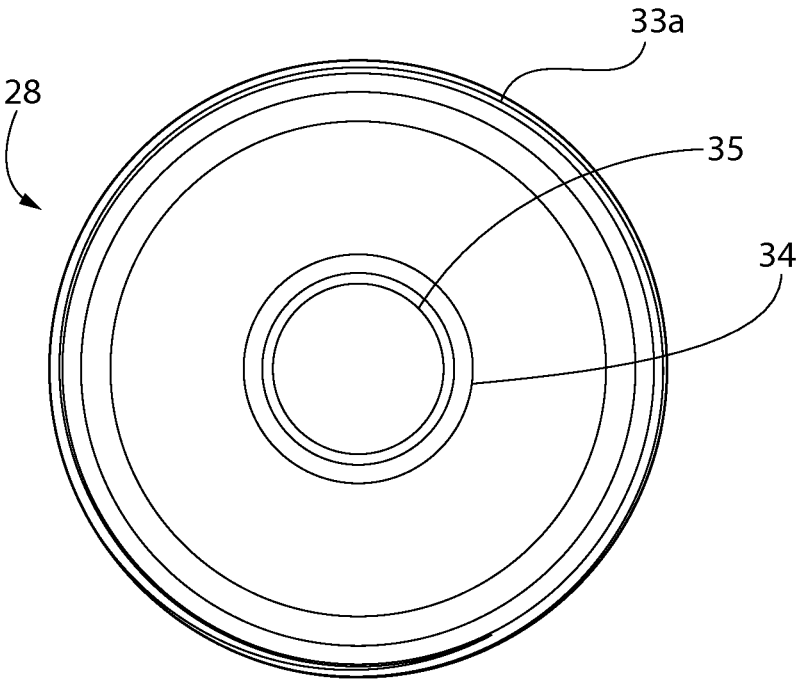
Figure 13:
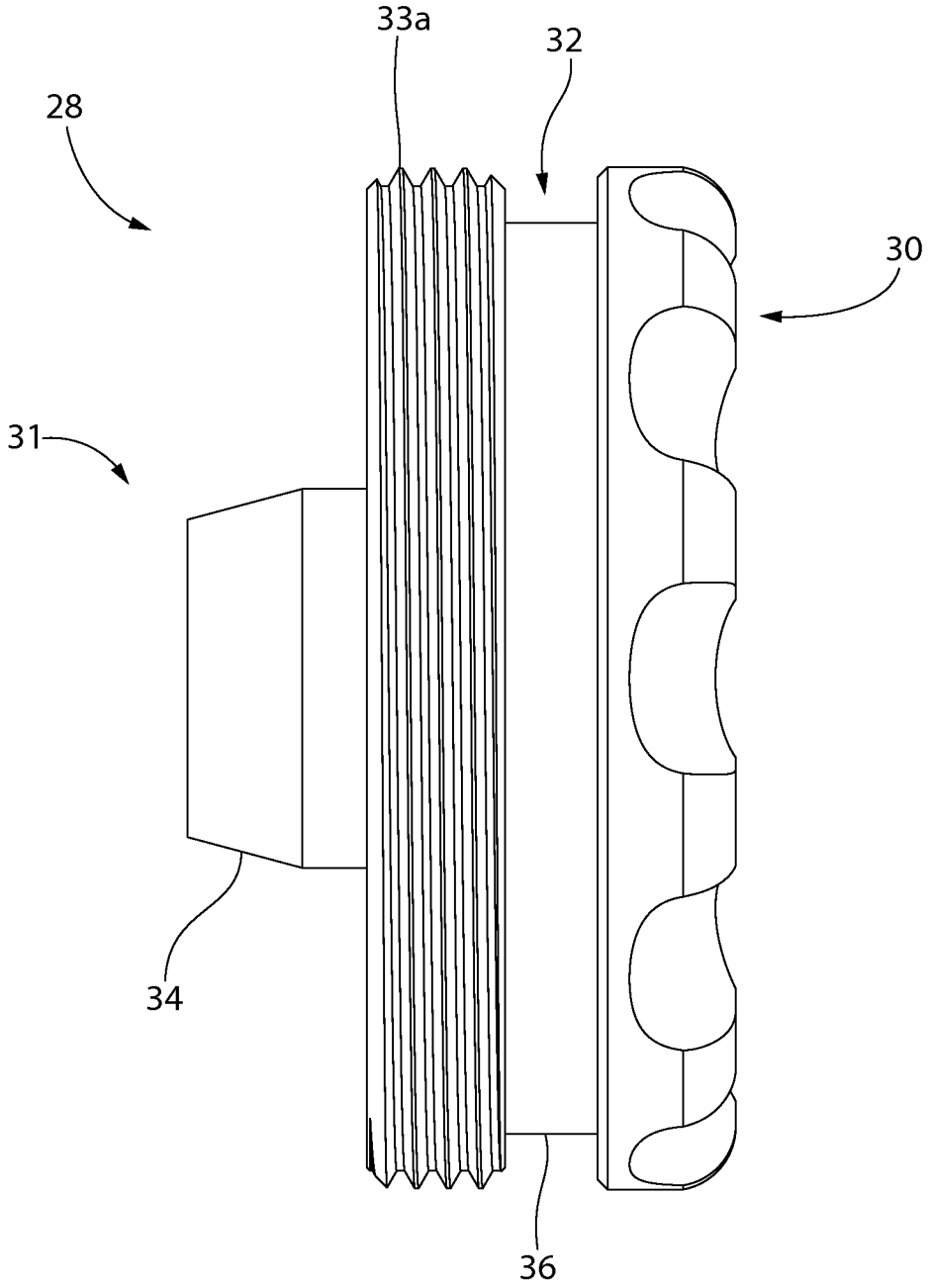
FIG. 13 is a side view thereof.
Figure 14:
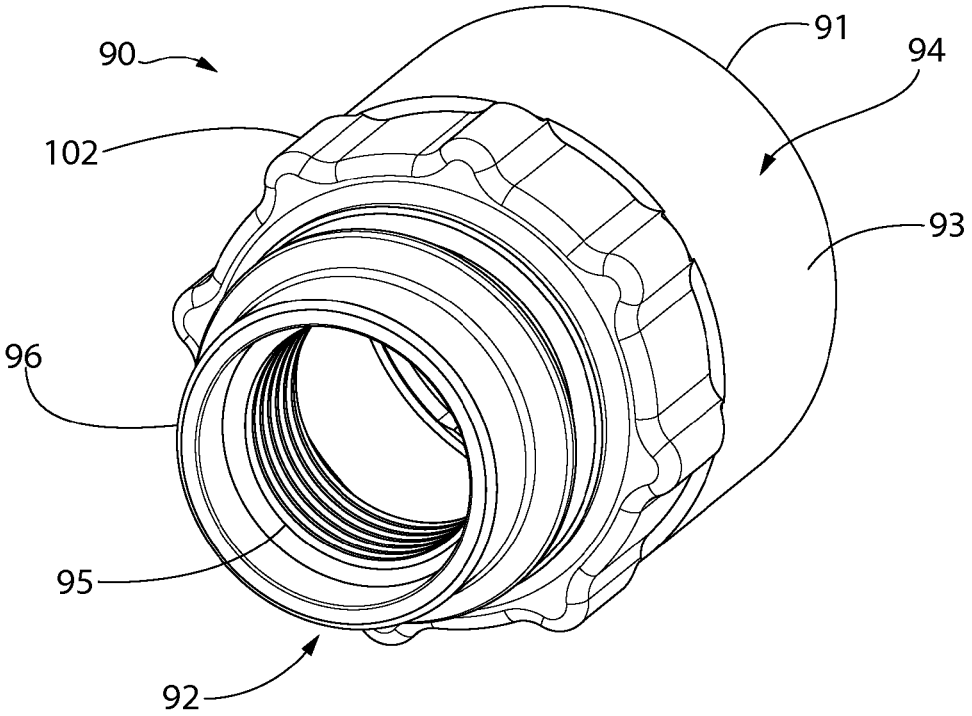
FIGS. 14 and 15 are front and rear perspective views respectively of a muzzle mount of the silencer of FIGS. 1 and 2.
Figure 15:
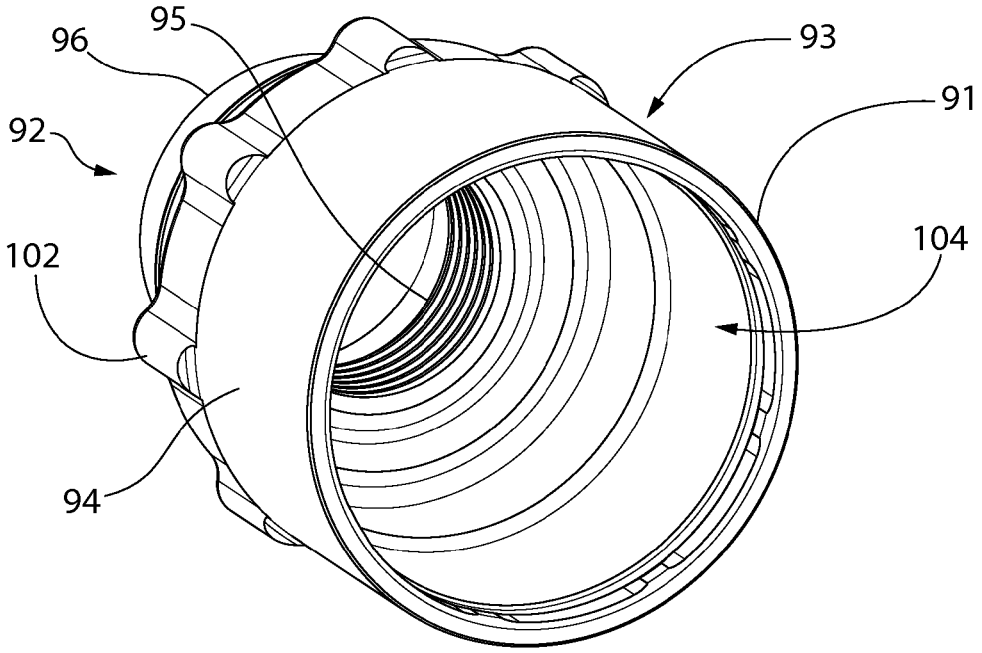
Figure 16:
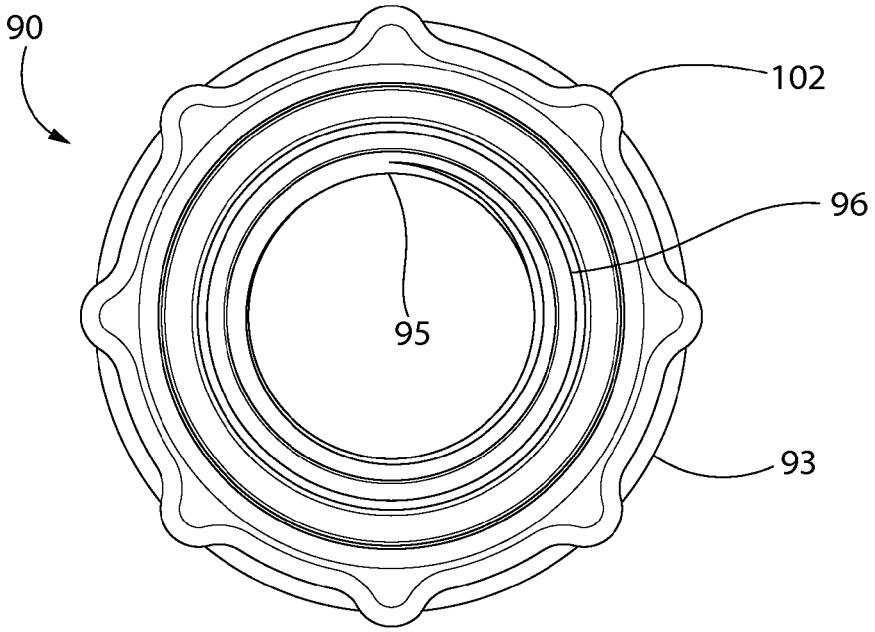
FIGS. 16 and 17 are front and rear end views respectively of the muzzle mount.
Figure 17:
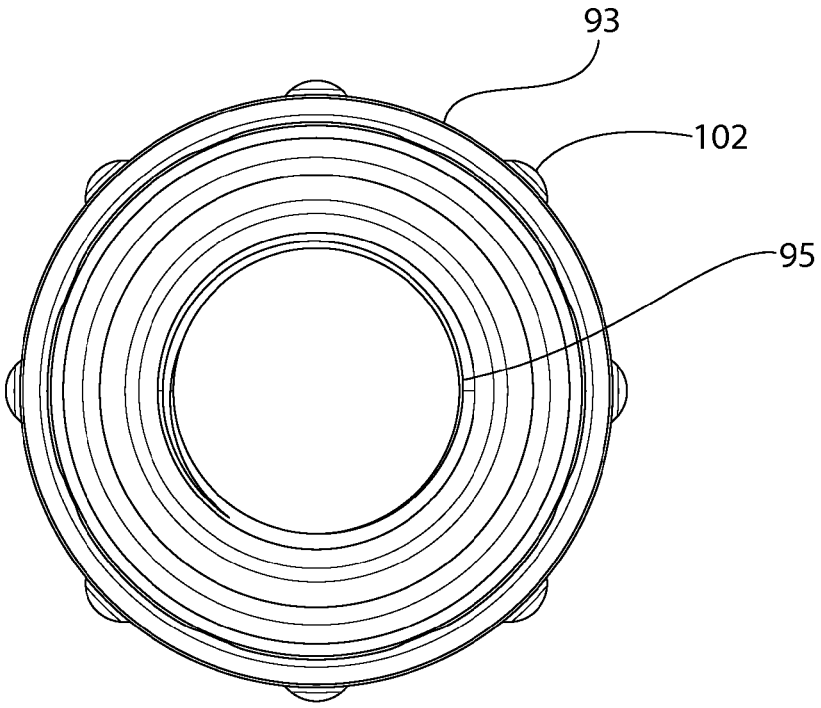
Figure 18:
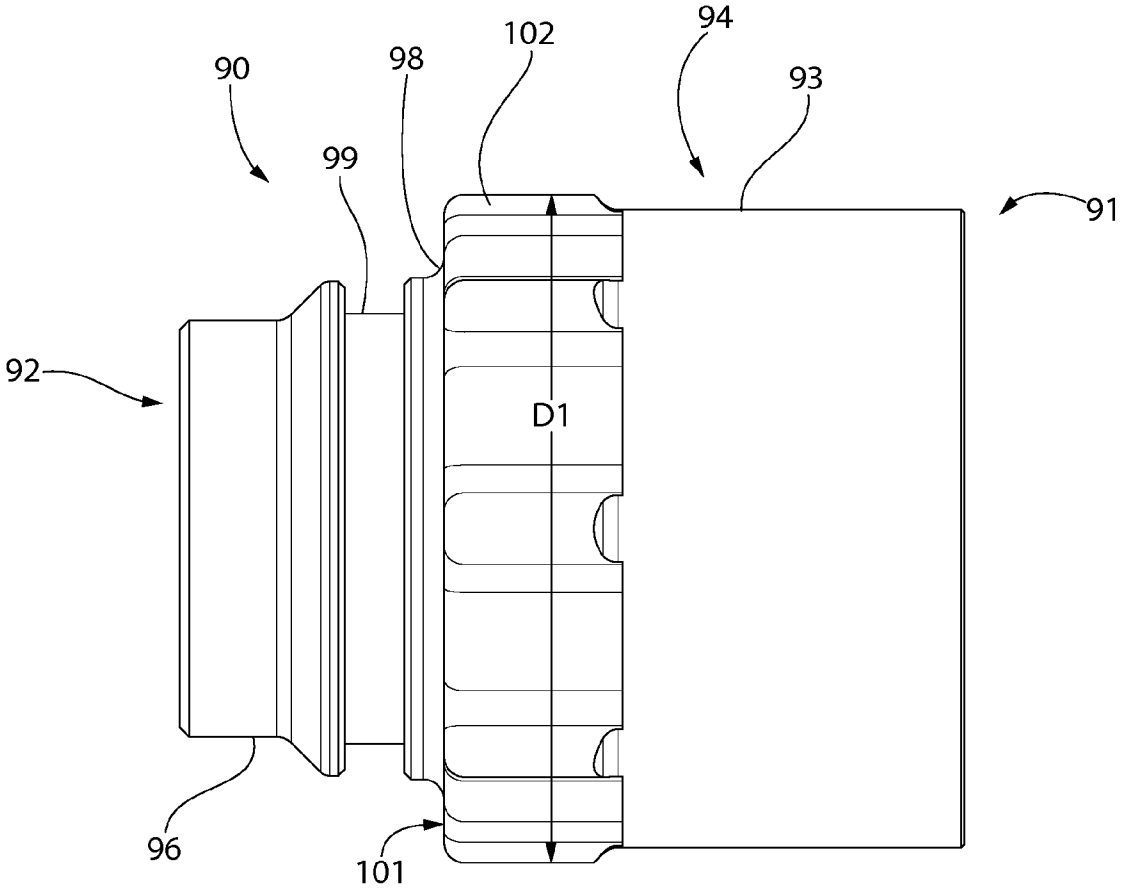
FIG. 18 is a side view thereof.
Figure 19:
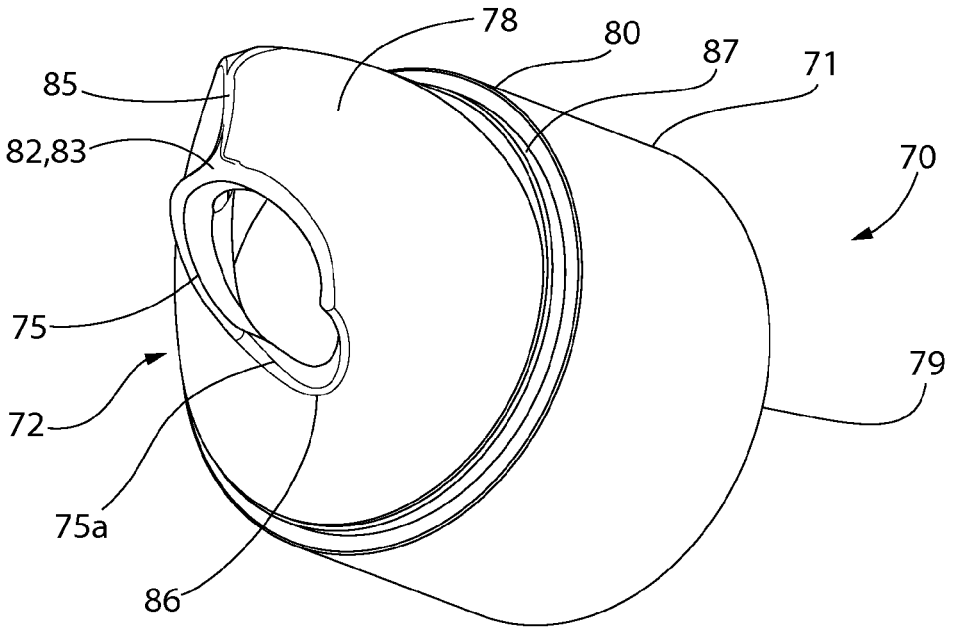
FIGS. 19 and 20 are front and rear perspective views respectively of a primary baffle of the silencer of FIGS. 1 and 2.
Figure 20:
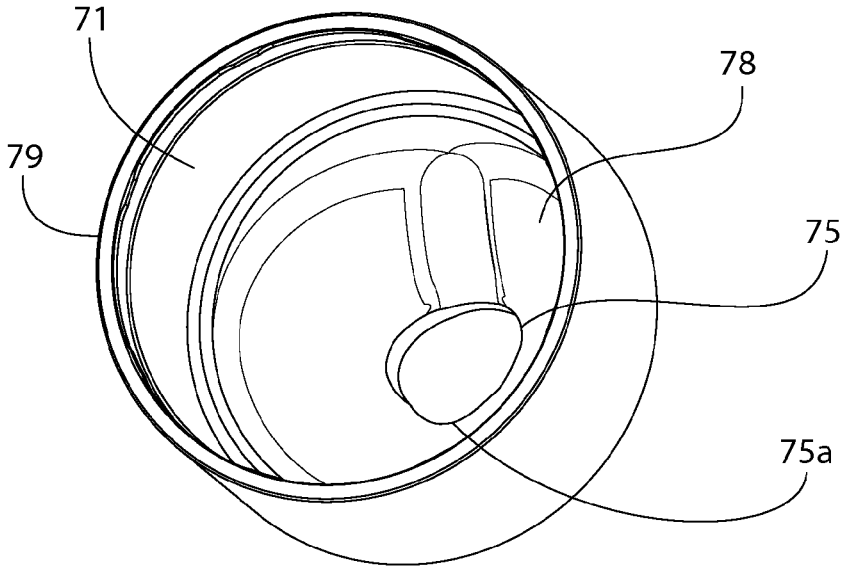
Figure 21:
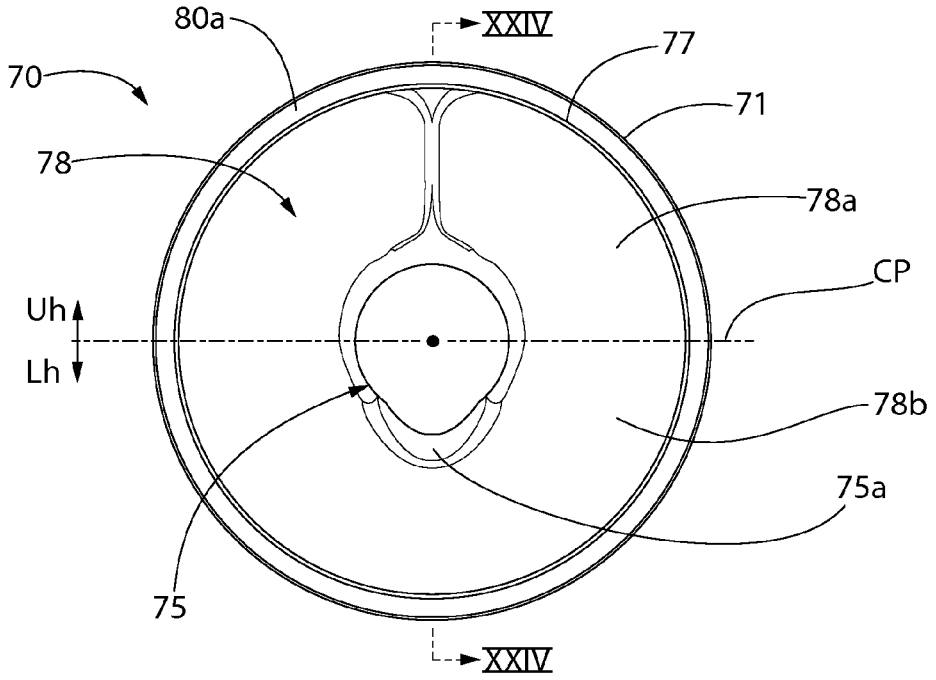
FIGS. 21 and 22 are front and rear end view respectively thereof.
Figure 22:
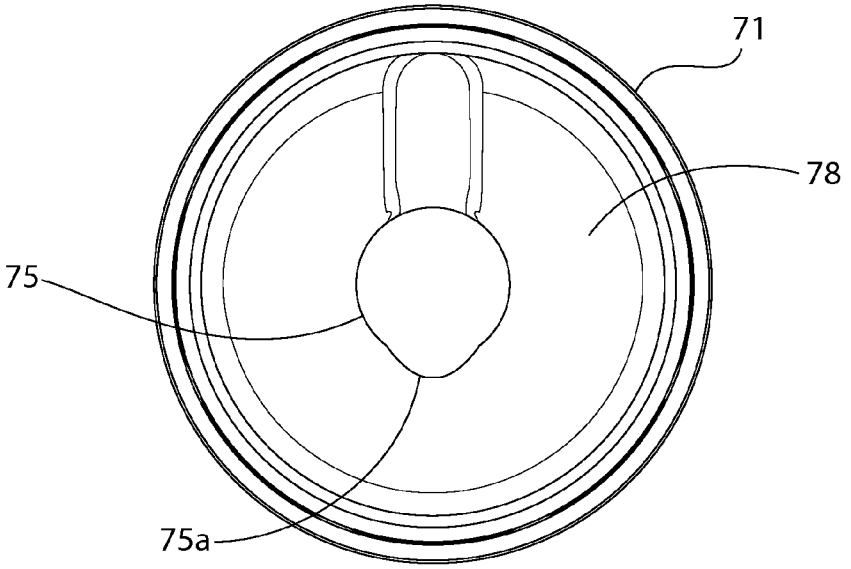
Figure 23:
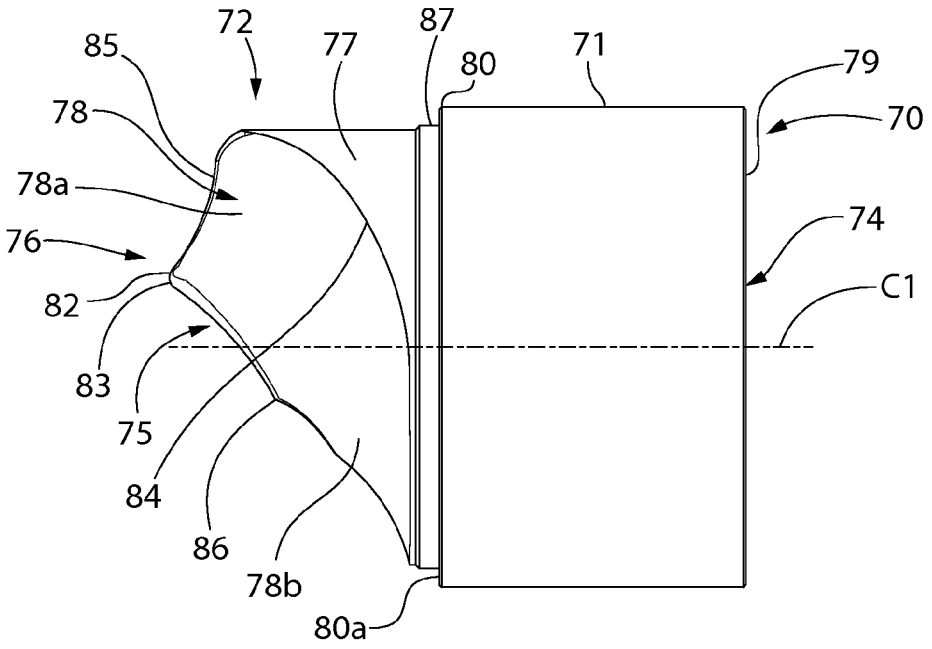
FIG. 23 is a side view thereof.
Figure 24:
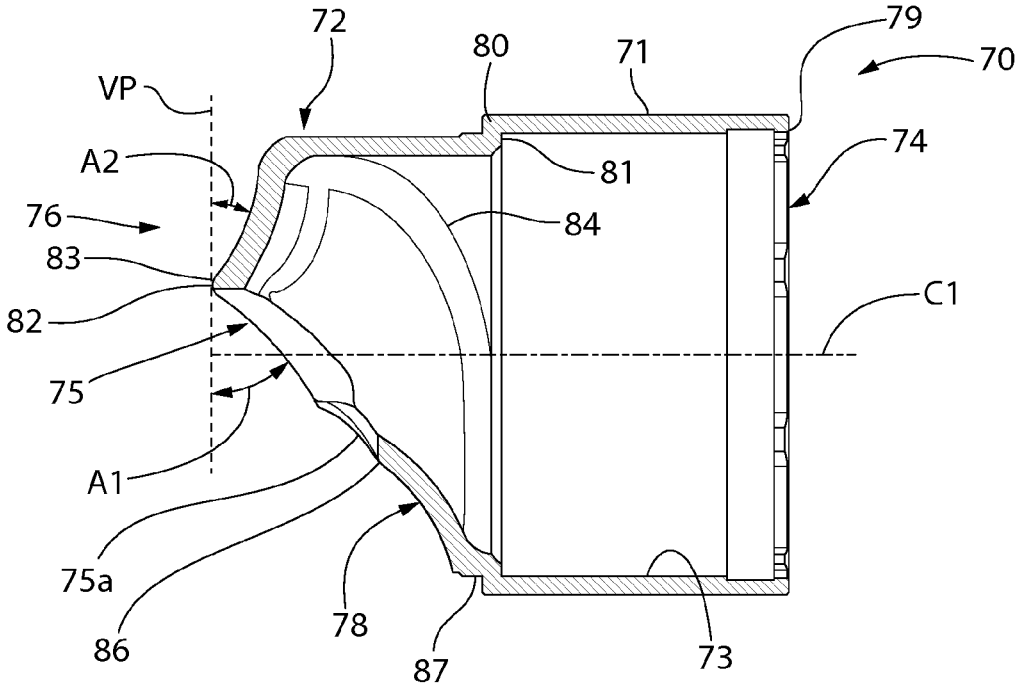
FIG. 24 is a longitudinal cross-sectional view thereof.
Figure 25:
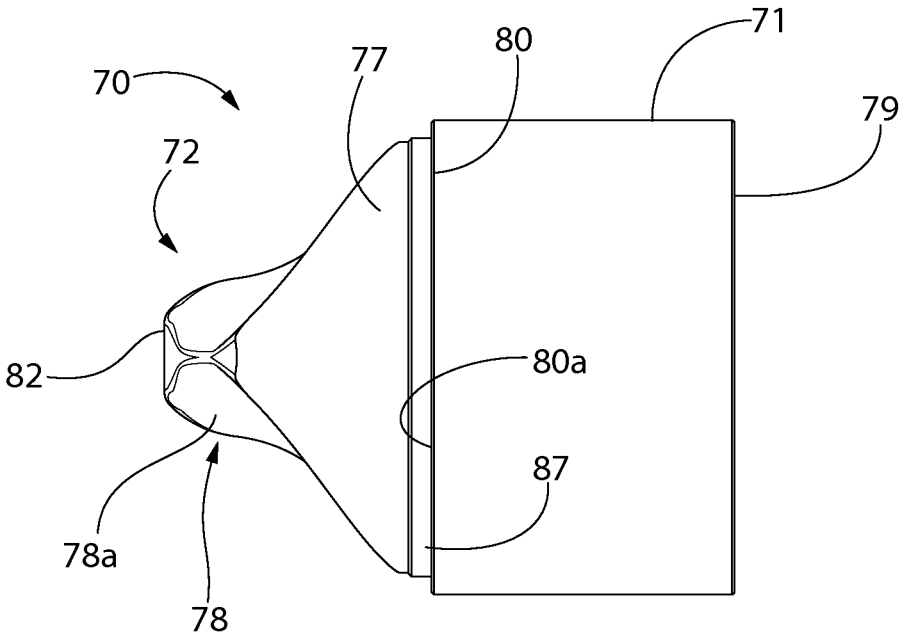
FIGS. 25 and 26 are top and bottom plan views thereof.
Figure 26:
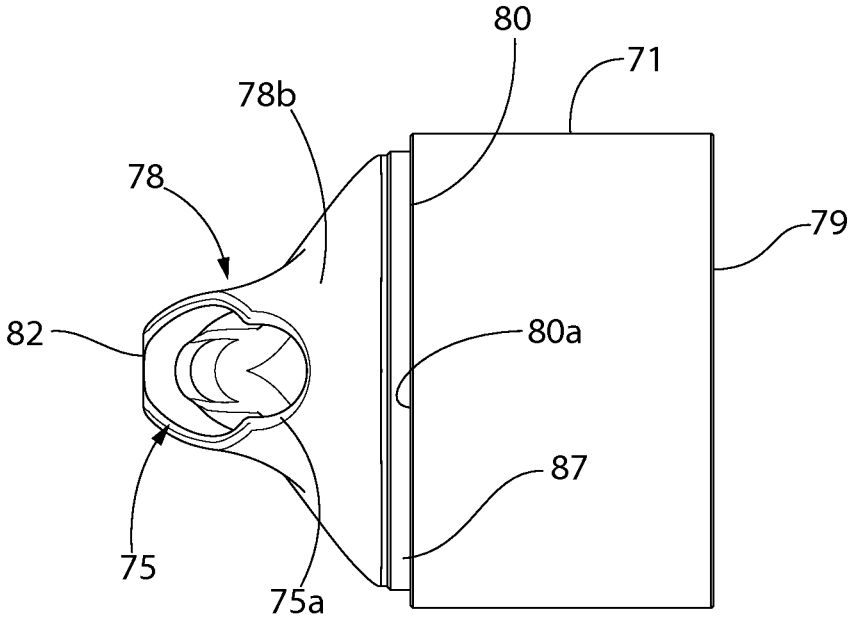

The blast baffle 50 and primary baffles 70 will next be described. Referring now to FIGS. 3 and 7-8, blast baffle 50 includes a tubular annular mounting sleeve 51 and an adjoining cone 52. In one embodiment, the cone 52 is formed integrally with the sleeve 51 as a unitary structural part thereof. Cone 52 may have a generally symmetrical hyperbolic shape in one embodiment with an arcuately curved sidewall 54 having an enlarged open front end adjacent to and communicating with the interior of sleeve 51, and which converges at a rear end to a central aperture 53 for receiving a projectile. Aperture 53 may be round and preferably has a diameter that matches the bore diameter of the barrel bore 18*a*. Central aperture 53 is coaxially and concentrically aligned with the longitudinal axis LA and barrel bore 18*a*, respectively. Longitudinal axis LA is concentrically aligned and coaxial with the barrel bore 18*a*.

Sleeve 51 has an outer diameter sized for placement adjacent the inside surface 26 of the silencer outer tube 21. Sleeve 51 thus has an outside diameter which is slightly smaller than the inside diameter of outer tube 21 sufficient to allow the blast baffle 50 to be slid inside the tube. The front end of the sleeve 51 is fully open and rear end transitions into the interior space of cone 52. Sleeve 51 in conjunction with cone 52 defines a cavity 55 sized for insertion of a cone of a primary baffle 70 at least partially therein, as best shown in FIGS. 7 and 8. Cavity 55 in conjunction with the primary baffle 70 immediately forward in the silencer forms one of several gas expansion chambers 110 in the silencer.

A recessed annular lip 56 is formed at a stepped transition on the outer surfaces between the sleeve 51 and cone 52. Lip 56 is defined by shoulder 50*a* that defines a rear facing abutment surface. The abutment surface and lip 56 engage the front end 91 of the muzzle mount 90 when the silencer is assembled. This forms an abutting interlocked gas-tight joint intended to prevent escape of combustion gases and fouling of the inside of the outer tube 21 with gummy carbon deposits which may make disassembly of the silencer for cleaning more difficult.

In one embodiment, cone 52 may have one or more through holes 57 to help equalize and balance the pressure of the combustion gases between blast baffle 50 and muzzle mount 90. The through holes 57 extend from the front side of the cone and cavity 55 completely through the cone to the rear side and adjoining cavity 104 of the muzzle mount. Any suitable size, shape, and number of through holes 57 as necessary to balance the pressure may be used. In one representative example, the holes 57 may be elongated and shaped as arcuately curved slots. Other shapes holes such as round or elliptical may be used in other non-limiting examples.

The primary baffles will now be described with reference to FIGS. 3, 7-8, and 19-24. For convenience in describing the primary baffles, the orientation of the primary baffles 70 shown for example in FIGS. 7, 8, and 21-24 will arbitrarily be considered an upright position defining a top and bottom of the baffle. It should be recognized that the baffle however may assume any rotational orientation when the silencer 20 is mounted to the barrel 18. The rotational orientation of baffles 70 does not affect the performance of the silencer for suppressing muzzle blast noise. Furthermore, the primary baffles 70 can be assembled with any individual baffle rotational alignment without any degradation to accuracy or noise suppression.

Primary baffles 70 may each be configured similarly and include a hollow annular mounting body or sleeve 71 which is tubular in shape and an adjoining hollow cone 72. The interior region of the annular mounting sleeve 71 and cone 72 are in fluid communication and contiguous between the ends of the baffle 70. Baffles 70 thus each include an open front end 74, partially closed rear end 76, and axially extending cavity 73 formed therebetween extending through the mounting sleeve and cone. In one embodiment, the cone 72 is formed integrally with the sleeve 71 as a unitary structural part thereof. In other embodiments, the cone may be a separate component attached to sleeve via any suitable means such as welding, adhesives, fasteners, etc.

Figure 28:
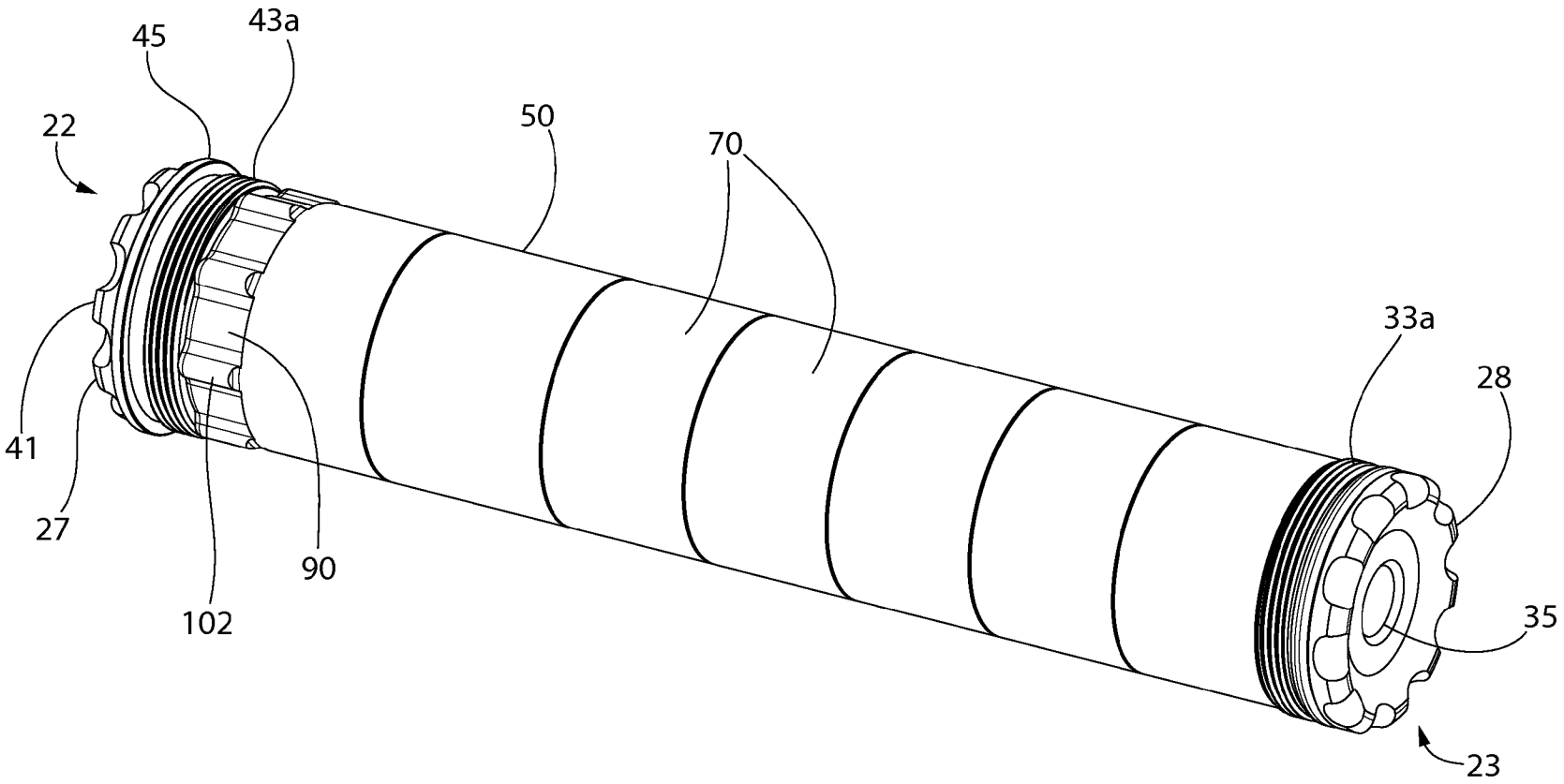
FIG. 28 is a perspective view of the silencer without the outer tube to show the stacked assembly of components.

Mounting sleeve 71 may be configured similarly to sleeve 51 of the blast baffle 50. The mounting sleeve 71 has an outer diameter sized for placement adjacent the inside surface 26 of the silencer outer tube 21. The outside diameter of sleeve 71 thus is slightly smaller than the inside diameter of outer tube 21 sufficient to allow the blast baffle 50 to be slid inside the tube. Mounting sleeve 71 defines a majority portion of the forwardly open cavity 73 sized for insertion of the cone 72 of the next adjacent forward primary baffle 70 at least partially therein, as best shown in FIGS. 7 and 8. Cavity 73 in conjunction with the next primary baffle 70 forward in the stack of baffles in the silencer defines another gas expansion chamber 110. The mounting sleeve 71 has a distal edge 79 which defines the front end 74 of the baffle and a proximal edge 80 which adjoins and from which the cone 72 extends axially towards the proximal end 22 of the outer tube 21. The distal edge has a stepped configuration in one embodiment forming a shoulder 80*a* which defines a rear facing abutment surface for engaging the distal edge 79 of the next adjacent forward primary baffle 70 when the silencer is assembled, or the distal end of the blast baffle 50 for the rear-most primary baffle (see, e.g. FIGS. 7A, 7B, and 8). A raised annular lip 87 may be disposed between the mounting sleeve 71 and cone 72 adjacent shoulder 80*a* which forms a frictional press fit into the distal edge 79 of the next adjacent baffle to create a gas tight seal and self-supporting assembled baffle array which does not require the outer tube 21 for support outside of the tube (see, e.g. FIG. 28). This creates a primary pressure retention boundary or barrier for retaining the combustion gas pressure which does not rely on the secondary pressure retention boundary or barrier formed by the outer sleeve 21. Note that the primary baffles 80, blast baffle 50, and muzzle mount 90 collectively create a sealed internal volume to prevent carbon/lead from building up on the inside of the outer tube 21.

Cone 72 includes an internally open base end 81 connected to mounting sleeve 71 and a free terminal end 82 defining a rear prominence. Terminal end 82 may be straight in one embodiment (see, e.g. FIGS. 25 and 26). Cone 72 has a complex asymmetrical and skewed compound shape in one embodiment combining an axially-straight part-cylindrical wall segment 77 extending rearward from sleeve 71 and an arcuately curved concave wall segment 78 adjoining wall segment 77. Wall segment 77 has a partial cylindrical configuration (hereafter "partial cylinder wall segment" for brevity) having a maximum axial length along a top surface of the wall segment (see, e.g. FIGS. 19, 23, 24, and 25). The axial length gradually decreases along arcuate contour lines 84 formed at a transition between adjoining portions of the partial cylindrical wall segment 77 and concave wall segment 78 moving downward along each of the lateral sides of the cone 72. Accordingly, an arcuate contour line 84 is present on both lateral sides of the cone 72. The axial length of the partial cylindrical wall segment 77 is at a minimum and transitions into the mounting sleeve 71 near the axial centerline C1 of the baffle 70 (see, e.g. FIGS. 23-24). When positioned in the silencer, the partial cylindrical wall segment 77 forms a portion of the entire cone 72 which is disposed adjacent and closest to the interior surface 26 of the outer tube 21. In top plan view, partial cylindrical wall segment 77 has a substantially triangular shape with the apex forming a prominence (see, e.g. FIG. 25).

The concave wall segment 78 of cone 72 extends obliquely to and from the axially-straight partial cylindrical wall segment 77. The concave wall segment 78 of cone 72 defines an oblong central aperture 75 which receives a projectile therethrough from the barrel bore. Central aperture 75 is coaxially and concentrically aligned with the longitudinal axis and barrel bore 18*a*, respectively. Central aperture 75 has a smaller open area than the inside diameter of the open base end 81 of the cone 72. The major axis of central aperture 75 is longer than a minor axis like an ellipse. Conversely for comparison, the symmetrical cone section of the proximal blast baffle 50 has a round central aperture 53. Preferably, the open area of central aperture 75 presents a rearward projected vertical diameter that matches or is slightly larger than the diameter of the barrel bore 18*a* to receive a projectile therethrough.

The central aperture 75 of primary baffle 70 is obliquely arranged and oriented to the longitudinal axis LA of the silencer 20 (see, e.g. FIG. 7B). Accordingly, an acute and oblique angle A3 is formed between longitudinal axis LA and the angled plane Ap in which the central aperture 75 substantially lies. Aperture 75 faces generally rearwards and downwards forming the hood or overhang above the aperture shown. Advantageously, the top hood of the aperture encourages the majority of the combustion gasses to spill over the wall of the baffle at the lowest, or forward-most, opening into the central aperture through the lower minor portion 75*a* of the aperture 75. This path of least resistance creates a strong cross-jetting that slows the progression of the gasses traveling in-line with the central aperture 75. This increases the sound deadening performance of the silencer, all of which is further described below For an arbitrary reference system to facilitate description, the baffle 70 has a horizontal centerline C1 which defines a horizontal reference plane Cp which includes centerline C1. Centerline C1 is coaxial with the longitudinal axis LA of the silencer when mounted therein and bisects the baffle 70 into upper and lower halves Uh and Lh (see FIGS. 21-24). The concave wall segment 78 defines a rear face of the baffle 70 which is divided into a concave upper half section 78*a* defined above the centerline C1 and reference plane Cp, and a concave lower half section 78*b* defined below the centerline C1 and horizontal reference plane Cp. The shape and axial length of the upper and lower half sections is different giving the upper and lower half sections a different side profile as illustrated in the side and side cross-sectional views of the baffle 70 (see, e.g. FIGS. 23-24). The upper half section 78*a* protrudes axially rearward towards rear or proximal end 22 of silencer 20 farther than the lower half section 78*b*. Accordingly, the upper half section 78*a* of the concave wall segment 78 has portions particularly above the terminal end 82 of the baffle 70 which are spaced farther rearward and apart from the mounting sleeve 71 of baffle 70 than any portions of the lower half section 78*b* in the illustrated embodiment. Upper half section 78*a* is disposed at an acute angle A2 to a vertical reference plane Vp that intersects the terminal end 82 of cone 78 which is less than the acute angle A1 formed between the lower half section 78*b* and reference plane Vp. Accordingly, the lower half section 78*b* has a greater slope than the upper half section 78*a*. The upper half section 78*a* primarily adjoins the partial cylindrical straight wall segment 77 whereas the lower half section 78*b* adjoins the mounting sleeve 71.

The upper and lower half portions 78*a*, 78*b* of the concave wall segment 78 collectively define the oblong central aperture 75. A rear prominence on the upper half portion 78*a* of the cone concave segment adjacent central aperture 75 defines a leading edge 83 of the aperture and a trailing edge 86 of the aperture is defined by the lower half portion 78*b*. In the orientation of silencer 20 shown in FIGS. 7A and 23-24, the leading edge 83 is a top edge and trailing edge 86 is a bottom edge of central aperture 75. Leading edge 83 projects farther rearward than the trailing edge 86 such that a projectile entering the central aperture 75 from the barrel bore 18*a* of barrel 18 after discharging the firearm first encounters the leading edge. The leading edge 83 thus creates a cantilevered hood or overhang above the central aperture 75 forcing a portion of the gas not traveling directly through the aperture downwards around the aperture and along the rear face of the cone. A concavely sloped prominent ridge 88 extends rearwards and downward from the apex of the part-cylindrical segment 77 to the leading edge 83 of central aperture 75 where the right and left halves of the upper portion 78*a* of concave wall segment 78 meet (see, e.g. FIGS. 19, 23, 24, and 25).

In some embodiments, a lower minor portion 75*a* of the central aperture 75 may have a smaller lateral width which is less than the diameter of the barrel bore 18*a* so that the projectile does not pass through this portion. Conversely, the upper major portion of the central aperture 75 having a lateral width larger than the minor portion 75*a* has a lateral width the same as or larger than the barrel bore 18*a* to allow passage of a projectile therethrough. The lower minor portion 75*a* adds extra open space below the projectile as it is passing through the central aperture 75 to permit combustion gas cross-jetting to initiate simultaneously.

Each primary baffle 70 is essentially shaped like a skewed cone. The axially longer (or taller) upper half section 78*a* section of the baffle cone segment 78 is designed to ramp the combustion gas pressure away from and around the central aperture 75 to gather at the lowest point on the lower half section 78*b* of the cone segment against the baffle face. As the combustion gas pressure builds enough to "spill" over the oblong rim of the cone segment that defines the aperture 75 and flows into the aperture through the lower minor portion 75*a*, this causes gas cross-jetting into the next forward baffle chamber 110.

Cross-jetting is extremely effective at disrupting the high speed combustion gasses traveling along the bore-line (i.e. longitudinal axis LA coaxial with central aperture 75), which if left alone would escape out of the suppressor at high pressures, thus creating a loud report. The gasses need to be slowed down to give them time to expand and cool. The cross-jetting of the first primary baffle 70 causes the gasses to divert from the bore-line, get caught in the next downstream baffle chamber 110, and then add to the cross-jetting flow of that baffle. Thus, the efficacy of each baffle 70 progressively improves closer to the front distal end 23 of the silencer. The asymmetrically skewed shape of the primary baffle 70 encourages this cross-jetting to occur faster than normal cone shapes. It is advantageous for this cross-jetting effect to occur quickly in order to slow as much escaping gas as possible.

The primary baffle 70 can be formed by any suitable method. In some fabrication processes, this compound baffle shape may be machined from a single piece of metal bar stock or investment cast to net shape and then finished by appropriate machining techniques. The invention is not limited by the production method(s) used.

A method for assembling a silencer 20 will now be generally described. The method described herein is one of several possible sequential approaches for assembling the silencer. Accordingly, numerous sequential variations are possible and the invention is not limited to any one approach.

The present method comprises providing an outer tube 21, a rear end cap 27, a front end cap 28, a muzzle mount 90, a blast baffle 50, and a plurality of primary baffles 70. The baffles 50, 70 are slideably inserted into the internal passageway 25 of the outer tube 21 through either the open front or rear ends 23, 22 of the tube. Accordingly, the baffles may be sized to fit through either open end of the tube. The baffles 50, 70 are inserted such that the cones 52, 72 face rearwards in the tube 21. As the baffles are inserted, the annular mounting sleeves 51, 71 of the baffles slideably engage the interior surface of the outer tube 21. In some embodiments, the baffles 50 and 70 may be press fit together to form a preassembled baffle stack outside of the outer tube 21 before insertion. In other embodiments, the baffles 50 and 70 may be inserted one at a time into the outer tube. Either approach may be used.

Next, the radially protruding splines 102 on the muzzle mount 90 are axially aligned with the mating axial grooves 103 in the rear end 22 of the outer tube. In other embodiments where the axial grooves 103 are formed in the muzzle mount and the splines 102 are formed on the rear end 22 of the outer tube 21 in the internal passageway 25, the grooves on the muzzle mount are axially aligned with the splines on the tube. The muzzle mount 90 is then inserted through the open rear end 22 of the outer tube with the splines 102 slideably engaging the grooves 103 regardless of which of these two components the grooves and splines are formed on. This leaves an end portion of the internal threads 43*b* inside the outer tube 21 exposed to receive the rear end cap 27 which is mounted after the muzzle mount 90 is installed, thereby locking the muzzle mount in the tube.

It bears noting that the radial splines 102 on the muzzle mount protrude outwards by an amount such that the ends of the splines define a diameter D1 (see, e.g. FIG. 18) which is larger than the inside diameter of the outer tube 21. Accordingly, the muzzle mount 90 in the present embodiment cannot be inserted through the front end 23 of the tube 21. The grooves 103 in the rear end of the outer tube however provide the additional clearance necessary allow insertion of the splines and muzzle mount 90 into the outer tube 21. Preferably, the grooves 103 extend only partially through the outer tube in the axial direction to avoid unnecessary machining, and more preferably the grooves have an axial length sufficient to engage the splines and limit insertion of the muzzle mount at a point which leaves some of the internal threads 43*b* of the tube exposed for mounting the rear end cap 27.

With the muzzle mount 90 seated now in the outer tube 21, the rear end cap 27 is then threadably coupled to the rear end of the tube. This traps and locks the muzzle mount into the outer tube 21. If not already installed, the front end cap 28 is threadably coupled to the front end of the outer tube. The rear and front end caps 27, 28 may be tightened using the castellations to secure the silencer assembly. The end put all internal components in compression and the outer tube 21 into tension. These components utilize the seals 37 and 100 such as rubber O-rings previously described that help prevent loss of torque due to the repeated firing of a mounted firearm. The assembled silencer 20 may be threadably coupled to the threaded muzzle end 18*c* of the barrel 18 by rotating the tube. The keyed anti-lock feature of the splines 102 and grooves 103 prevent the silencer assembly from being disassembled or loosened when the outer tube 21 of the silencer is affixed to the firearm.

Advantageously, the rear end cap mounting arrangement disclosed herein in which the rear end 22 of the outer tube 21 is internally threaded 43*b* for coupling the rear end cap 27 allows the outer tube to be made mechanically simple and with a basic tube configuration being formed from a standard solid tube without any appurtenances, flanges, protrusions, or other surface features needed for mounting the end cap that may otherwise make fabrication more complex and expensive. In addition, it bears noting that the rear end cap has a plain aperture 44 without threading since it is not relied upon for mounting the silencer 20 to the firearm barrel 18. Rather, the threaded nozzle 96 of the muzzle mount 90 which extends through the entrance aperture 44 of the rear end cap 27 mounts the silencer to the firearm barrel.

Any suitable materials may be used for the silencer assembly and its components. Preferably, the components are all formed of an appropriate metal or metal alloy (with exception of the seals described herein) such as aluminum, steel, titanium, or other. In one representative but non-limiting example, the rear and front end cap 27, 28 may be formed of aluminum or stainless steel. The muzzle mount 90 may be formed of stainless steel. The blast and primary baffles 50, 70 may be formed of stainless steel or aluminum. The outer tube 21 may be formed of aluminum, preferably in some embodiments from barstock or cold hammer forged aluminum. The tube 21 could also be made of preferably titanium due to its light weight and strength, or alternatively but less preferably of a steel material such as stainless due to its added weight.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A firearm silencer comprising:

a longitudinal axis;

an outer tube defining a proximal end configured for mounting on a firearm barrel, a distal end, and an internal passageway extending between the proximal and distal ends;

a plurality of first baffles longitudinally stacked in the internal passageway between the proximal and distal ends of the outer tube;

each of the first baffles comprising an annular mounting sleeve disposed adjacent the outer tube and a cone projecting axially rearward from the mounting sleeve towards the proximal end of the outer tube, the cone defining an oblong central opening concentrically aligned with the longitudinal axis for receiving a projectile therethrough, the oblong central opening being obliquely angled to the longitudinal axis of the silencer; and a plurality of gas expansion chambers formed between the first baffles.

2. The silencer according to claim 1, wherein the cones of the first baffles have a leading edge that is axially spaced farther apart from the mounting sleeve than a trailing edge defining a bottom of the oblong opening.

3. The silencer according to claim 2, further comprising a lower minor portion of the central aperture having a lateral width which is less than an upper major portion of the central aperture.

4. The silencer according to claim 1, wherein the cones of the first baffles each have an asymmetrical transverse cross section about the longitudinal axis.

5. The silencer according to claim 1, wherein the cones of the first baffles each have a concave upper half section and a concave lower half section, the upper half section having a different side profile than the lower half section.

6. The silencer according to claim 1, further comprising a second baffle inside the outer tube between the proximal end and the primary baffles, the second baffle having a different configuration than the first baffle.

7. The silencer according to claim 4, wherein the second baffle includes an annular mounting sleeve and a symmetrically shaped cone protruding rearward from the mounting sleeve, the cone defining a central aperture concentrically aligned with the longitudinal axis for receiving a projectile therethrough and one or more through holes.

8. The silencer according to claim 1, further comprising a muzzle mount disposed in the proximal end of the outer sleeve, the muzzle mount including an annular mounting sleeve and rearwardly open threaded nozzle which is configured to engage a threaded muzzle end of the firearm barrel for affixing the silencer thereto.

9. The silencer according to claim 8, wherein a rearwardly open annular space is formed in the proximal end of the outer sleeve between the outer sleeve and the nozzle which receives a threaded mounting portion of a proximal end cap that engages mating threads formed in the internal passageway of the outer sleeve to couple the proximal end cap to the outer sleeve.

10. The silencer according to claim 9, wherein the proximal end cap traps the annular mounting sleeve of the muzzle mount in the outer sleeve when the proximal end cap is mounted to the outer sleeve.

11. The silencer according to claim 9, wherein the nozzle extends through an aperture in the proximal end cap to threadably engage the threaded end muzzle end of the firearm barrel.

12. The silencer according to claim 1, further comprising a plurality of circumferentially spaced apart axial grooves formed in the proximal end of the outer sleeve, each of the axial grooves configured and arranged to receive a mating radially protruding anti-rotation spline formed on a muzzle mount disposed in proximal end of the outer tube, the muzzle mount threaded for attachment to a threaded muzzle end of the firearm barrel.

13. The silencer according to claim 1, further comprising a distal end cap threadably attached to the distal end of the outer sleeve, the distal end cap including a center exit aperture defined by a tubular extension which extends rearward from an end wall of the distal end cap.

14. The silencer according to claim 1, wherein the cone includes a partial cylindrical wall segment disposed proximate to the outer sleeve and an adjoining concave wall segment which defines the central aperture.

15. A firearm with silencer comprising:

a barrel having a barrel bore for receiving a projectile and a threaded muzzle end;

a longitudinal axis coaxial with the barrel bore;

a silencer comprising:

an outer tube defining an internal passageway extending between proximal and distal ends of the outer tube;

a distal end cap attached to the distal end of the outer tube and defining an exit aperture coaxially aligned with the longitudinal axis;

a proximal end cap attached to the proximal end of the outer tube and defining an entrance aperture coaxially aligned with the longitudinal axis;

a muzzle mount disposed in the proximal end of the outer tube, the muzzle mount threadably engaging the threaded muzzle end of the barrel coupling the silencer thereto;

a plurality of primary baffles longitudinally stacked inside the outer tube between the proximal and distal end caps;

a blast baffle disposed between the primary baffles and proximal end cap; and an anti-rotation feature comprising a plurality of circumferentially spaced apart radial splines formed on one of the muzzle mount or outer tube, each radial spline engaging a mating axial groove formed in the other one of the muzzle mount or outer tube without the splines, the anti-rotation feature preventing relative rotation between the muzzle mount and outer tube when the silencer is threaded onto the barrel.

16. The firearm according to claim 15, wherein the muzzle mount includes a threaded nozzle which threadably engages the threaded muzzle end of the barrel.

17. The firearm according to claim 15, wherein the muzzle mount, primary baffles, and blast baffle each include an annular mounting sleeve, the mounting sleeves being interlocked to form a self-supporting gas-tight primary pressure retention barrier independently of a secondary pressure retention barrier formed by the outer sleeve.

18. The firearm according to claim 17, wherein:

the mounting sleeves of the primary baffles each include a shoulder which engages a front end of adjacent primary baffles and the blast baffle, and the mounting sleeve of the blast baffle includes a shoulder which engages a front end of the muzzle mount.

19. The firearm according to claim 15, wherein the proximal and distal end caps are threadably attached to the outer sleeve, the axial grooves interrupting threads on the proximal end of the outer sleeve.

20. The firearm according to claim 15, wherein each of the first baffles comprises an annular mounting sleeve disposed adjacent the outer tube and a cone projecting axially rearward from the mounting sleeve towards the proximal end of the outer tube, the cone defining an oblong central opening obliquely angled to the longitudinal axis for receiving a projectile therethrough.

21. A method for assembling a silencer for a firearm, the method comprising:

providing an outer tube, a rear end cap, a front end cap, and a muzzle mount, the outer tube defining a rear end for threadable mounting on a firearm barrel, a front end, and an internal passageway extending between the front and rear ends;

slideably inserting a plurality of baffles into the internal passageway through the rear or front end of the outer tube;

axially aligning a plurality of radial splines on the muzzle mount or the outer tube with a mating plurality of axial grooves on the other of the muzzle mount or the outer tube without the radial splines;

slideably inserting the muzzle mount through the rear end of the outer tube towards the front end by slideably engaging the splines in the grooves; and threadably coupling the rear end cap onto the rear end of the outer tube, the muzzle mount being locked into the outer tube by the rear end cap;

wherein relative rotation between the muzzle mount and outer tube is prevented by engagement between the radial splines and the axial grooves.

22. The method according to claim 21, wherein the muzzle mount and rear end cap are attached first to the outer tube and the plurality of baffles are then inserted through the front end of the outer tube.

23. The method according to claim 21, wherein the baffles each include an annular mounting sleeve engaging the outer tube and an asymmetrical skewed cone extending rearwards from the mounting sleeve towards the rear end of the outer tube, the cone defining an oblong central aperture having a greater major axis than minor axis.

24. The method according to claim 21, wherein the muzzle mount includes an annular mounting sleeve positioned adjacent the outer tube and a reduced diameter threaded nozzle extending rearward from the mounting sleeve which is received through a rear aperture in the rear end cap for attaching a firearm barrel.

* * * * *